US008397780B2

(12) United States Patent
Vianello et al.

(10) Patent No.: US 8,397,780 B2
(45) Date of Patent: Mar. 19, 2013

(54) AUTOMATIC MACHINE FOR APPLYING A SPACER PROFILE ON A GLASS SHEET, AND METHOD THEREFOR

(75) Inventors: Fortunato Vianello, Vallio (IT); Dino Moschini, Roncade (IT)

(73) Assignee: FOR.EL. S.p.A., Roncade, Frazione Vallio (IT)

( * ) Notice: Subject to any disclaimer, the term of this patent is extended or adjusted under 35 U.S.C. 154(b) by 24 days.

(21) Appl. No.: 12/588,424

(22) Filed: Oct. 15, 2009

(65) Prior Publication Data

US 2010/0096069 A1 Apr. 22, 2010

(30) Foreign Application Priority Data

Oct. 17, 2008 (IT) ..... TV2008A0129

(51) Int. Cl.
*G05G 15/00* (2006.01)

(52) U.S. Cl. ..... 156/361; 156/443; 156/459; 156/500; 156/501; 156/510

(58) Field of Classification Search ..... 156/99, 156/106, 107, 109, 361, 443, 459, 500, 501, 156/510

See application file for complete search history.

(56) References Cited

U.S. PATENT DOCUMENTS

2006/0076110 A1* 4/2006 Lisec ..... 156/361

FOREIGN PATENT DOCUMENTS

| | | | |
|---|---|---|---|
| EP | 1 528 214 | A | 5/2005 |
| GB | 2 045 229 | A | 10/1980 |
| WO | WO 2005/078227 | A | 8/2005 |

* cited by examiner

*Primary Examiner* — Christopher Schatz

(74) *Attorney, Agent, or Firm* — Modiano & Associati; Daniel O'Byrne; Albert Josif

(57) ABSTRACT

An automatic machine and an automatic method for the application of a spacer profile, preferably made of expanded synthetic material, on a glass sheet in order to compose the insulating glazing unit, after extrusion of a thermoplastic sealant on a portion of each one of its faces designed for mating. The process for extrusion of the sealant on the profile is independent of the process for applying the profile on the glass sheet, so that therefore each one of the two processes can be performed by using its optimum parameters.

6 Claims, 23 Drawing Sheets

AUTOMATIC MACHINE FOR APPLYING A SPACER PROFILE ON A GLASS SHEET, AND METHOD THEREFOR

The present invention relates to an automatic machine for applying a spacer profile on a glass sheet, and to a method therefor.

BACKGROUND OF THE INVENTION

Currently it is known to deposit the spacer frame or the spacer profile on a glass sheet to then mate the assembly to a second glass sheet so as to constitute the insulated glazing unit. This operation can also be repeated for obtaining an insulating glazing unit consisting of three glass sheets and two spacer frames or profiles, as well as n sheets and n−1 spacer frames or profiles.

In order to better understand the configuration of the glass sheet, not so much in its possible individual use but especially in its use in combination with other components, in particular the spacer frame or profile for constituting the insulating glazing unit 1, some concepts related to the intermediate components, i.e., the glass sheets 2 and the spacer frame or profile 3, and the final product, i.e., the insulating glazing unit 1, are summarized hereinafter, with reference to the figures, assuming that the subsequent use of the insulating glazing unit is known, i.e., as a component of doors or windows or of curtain walls or of structural faces. For organizing the description, it is easier to begin from the final product, breaking it down into its components.

The insulating glazing unit 1, in its traditional version, consists of a composition of two or more glass sheets 2, which are separated by one or more spacer frames 3, which are generally metallic, hollow and finely perforated in the face that is directed inwardly, the spacer frames containing, in their hollow part, hygroscopic material 4, which can exchange its capacity to absorb humidity through such fine perforations, and being coated, on the side walls that are adjacent to the glass sheets 2, with a first sealant 6, which has a sealing function and, on the outer wall, with a second sealant 7, which provides a mechanical coupling with the glass sheets 2 and the chamber (or chambers) delimited by the glass sheets and by the frame (frames) being able to contain air or gas 8 or gas mixtures 8 that give the insulating glazing unit particular properties, for example thermally insulating and/or soundproofing properties.

The use of a spacer profile 3 has recently become widespread that has a substantially rectangular cross-section and is made of expanded synthetic material (by way of non-limiting example: silicone or EPDM), which incorporates in its mass the hygroscopic material 4 and is pre-spread with acrylic adhesive 5 protected by a removable film 5', as a substitute for the thermoplastic sealant 6. This innovative profile has two advantages: the low coefficient of heat transmission by conduction and the bond with the glass sheet, which becomes instantaneous because it is due to the acrylic adhesive 5 and is not, as in the case of spacer frames 3 made of metallic material or plastics, only due to the traditional thermoplastic sealant 6, which is subject to flow until the second cold sealant described hereinafter catalyzes, or to the second hot sealant (which is called hot melt and is particularly known in combination with the profile made of synthetic material) which is subject to flow even when it has cooled.

The use of the spacer profile 3 described in the preceding paragraph, i.e., pre-spread with the acrylic adhesive 5, but further provided with a recess (or rather a receptacle) 6' designed to subsequently accommodate the thermoplastic sealant 6, has become widespread even more recently. This product belongs to the so-called TriSeal™ technology and constitutes an important innovation with respect to the traditional dual seal technology referred to in the two preceding paragraphs in the two different embodiments. The product is, for example, particularly employed in structural faces, in which, since the external sealant does not have gas- and water vapor-tight properties because it is silicone-based, these properties must be provided by the thermoplastic sealant 6. The levels of sealing therefore become three as opposed to the traditional two. The first one is obtained by means of the acrylic adhesive 5 (which provides immediate and stable anchoring between the glass sheets 2 and the spacer profile 3, with the advantage that it is possible to support stably the insulating glazing unit by gripping with suckers just one of the two or more glass sheets); the second one (which was the first one in the traditional system) is provided by the butyl sealant 6 (with a sealing function against the passage of moisture and gas), i.e., by the thermoplastic sealant; the third one (which was the second one in the traditional system) is provided by the polysulfide or polyurethane or silicone sealant 7 (which has the function of a mechanical-elastic bond between the components of the insulating glazing unit 1, consisting of the glass sheets 2 and the spacer frame 3), i.e., by the elastomeric sealant.

Since the present invention is about the production of an insulating glazing unit with the TriSeal™ technology, the numbering of the components has been organized so that the corresponding sealants 5, 6, 7, which indeed constitute the triple seal, are numbered progressively.

The glass sheets 2 used in the composition of the insulating glazing unit 1 can have different configurations depending on the use of such unit; for example, the outer glass sheet ("outer" being understood with respect to the interior of the building) can be normal or reflective/selective (for limiting heat input during the summer months) or laminated/armored (for intrusion prevention/vandalism prevention functions) or laminated/tempered (for safety functions) or combined (for example reflective and laminated, for obtaining a combination of properties). The inner glass sheet ("inner" being understood with respect to the interior of the building) can be normal or of the low-emissivity type (in order to limit heat loss during the winter months) or laminated/tempered (for safety functions) or combined (for example, of the low-emissivity and laminated type for obtaining a combination of properties).

From the above summary, it is already evident that a manufacturing line, in order to provide the insulating glazing unit product 1, requires many processes in sequence and in particular comprises the process of applying the spacer frame or spacer profile 3.

The process steps for producing the insulating glazing unit 1, each requiring a corresponding and particular machine, typically and preferably with a vertical arrangement (actually slightly inclined with respect to the vertical plane) to be arranged in series with respect to the other complementary ones, are, by way of non-exhaustive example and not in their entirety necessary, the following:

- edging on the peripheral face of the glass sheet in order to remove any coatings, so as to allow and maintain over time the bond of the sealants and, in the case of the subject of the present application, of the acrylic adhesive 5 and of the thermoplastic sealant 6 and elastomeric sealant 7.
- beveling of the sharp edges of the glass sheet, both in order to eliminate the edge defects introduced with the cutting operation and therefore the consequent possibility of crack triggering and to reduce the risks of injury in subsequent handling both of the glass sheet and of the insulating glazing unit.

washing of the individual glass sheets, with alternation of inner glass/outer glass (the orientation being as defined earlier).

application of the spacer frame: the previously manufactured frame, filled with hygroscopic material 4 and covered on its lateral faces with the thermoplastic sealant 6 which has sealing functions, in machines which are external with respect to the production line of the insulating glazing unit 1, is applied on one of the glass sheets that constitute the insulating glazing unit 1 at an appropriately provided station of the line for production of the insulating glazing unit 1. As an alternative, a continuous strip of spacer profile 3 made of expanded synthetic material is unwound from a spool 9 and is applied on one of the two glass sheets 2 until it forms a closed frame, which is built directly in adhesion on the glass sheet by means of the acrylic adhesive 5, after removal of the protective film 5', and on the same line for the production of the insulating glazing unit 1. As a further alternative, and this regards the present invention, a continuous strip of spacer profile 3 made of expanded synthetic material is unwound from a spool 9 and is applied so that the wall 3*p* adheres to the first one of the two glass sheets 2 until it forms a closed frame, which is built directly against the glass sheet by means of the acrylic adhesive 5, after removal of the protective film 5' and extrusion of the butyl sealant 6.

mating and pressing of the glass sheet/frame(s) assembly.

filling with gas of the chamber(s) thus obtained, either already during the preceding mating and pressing step or after said step, resorting in this case to the provision of holes in the spacer frame 3 according to several known techniques for the introduction of the gas.

second sealing of the perimetric compartment delimited by the internal faces of the glass sheets 2 and by the outer wall of the spacer frame 3; combining all the possibilities that can be used in the various processes, it can be performed with two-part/single-part polysulfide, two-part/single-part polyurethane, two-part/single-part silicone, hot melt, reactive hot melt (all are cold sealants, except for the hot melts, as is evident from the name itself).

The process steps listed above can be performed by a respective machine automatically or semiautomatically.

In particular, in the known dual seal technique, the deposition of the spacer profile 3 made of expanded synthetic material is performed manually (i.e., with the intervention of the operator) typically on a tilting table, which changes its arrangement from vertical when it receives the glass sheet from the line to horizontal when the operator deposits the profile. It can be performed automatically in a section of the vertical line for the production of the insulating glazing unit 1, and therefore with a vertical arrangement.

In the now currently available technique known as TriSeal™, the deposition of the spacer profile 3 made of expanded synthetic material is performed manually (i.e., with the intervention of the operator), typically on a tilting table, which changes its arrangement from vertical when it receives the glass sheet from the line to horizontal when the operator deposits the profile. It also can be performed automatically (i.e., without the intervention of the operator), typically and preferably in a section that has a vertical arrangement like the insulating glazing unit production line itself (without however excluding solutions that have a horizontal arrangement) after the application, which is again automatic, of the lateral beads of butyl sealant 6 on the recesses (receptacles) 6' of the lateral faces 3*p* and 3*s* of the spacer profile 3, in a station 500 that is intermediate between the station 400 for unwinding the spool 9 and the station 200 for the application of the spacer profile 3 on the first glass sheet 2.

Prior art in the same field, regarding machines and methods for applying the spacer profile on a glass sheet is disclosed in the documents mentioned hereinafter:

WO 2005/078227 A1, teaches working on the spacer profile after the spacer profile 3 has been mated on both walls 3*p*, 3*s* to the glass sheets 2 and is retained effectively by them by means of the adhesive sealant 5.

EP 1 528 214 A1, corresponding to DE 103 50 312 A1 dated Oct. 28, 2003, and US 2005/0247392 A1, in the name of Lisec Peter, specifically related to the application of a thermoplastic sealant 6 on a spacer profile 3 made of expanded synthetic material, which however is expressly not provided with adhesive sealant 5.

WO 2005/078227 A1, corresponding to US2005/0167028 A1 dated Feb. 4, 2004, in the name of Reichert Gerhard, assigned to Edgetech specifically related to the application of a thermoplastic sealant 6 on the recesses (receptacles) 6' of the spacer frame 3 made of expanded synthetic material already provided with adhesive sealant 5 protected by a film 5' on part of its side walls.

IT-TV2008A000047 dated Apr. 4, 2008, of the same applicant For. El. BASE di Vianello Fortunato & C. s.n.c., with respect to which the present invention is an improvement.

In summary, these documents respectively teach, all with reference to a spacer profile 3 made of expanded synthetic material, the following:

EP 1 528 214 A1, application of the thermoplastic sealant at a station that is intermediate between the unwinding reel of the spool and the machine for applying the spacer profile 3 on the first glass sheet 2;

WO 2005/078227 A1, application of the thermoplastic sealant at a station that is intermediate between the unwinding reel of the spool and the machine for applying the spacer profile 3 provided with acrylic adhesive 5 on the first glass sheet 2;

IT-TV2008A000047, application of the thermoplastic sealant 6 directly on the extrusion head after cutting into the spacer profile 3 in the portions that correspond to the corners or cusps of the frame.

Also known are devices which extrude the thermoplastic sealant 6, on a spacer profile 3 that is already coated with acrylic adhesive 5 and is provided with a receptacle 6', after the unwinding of the spool along the path of the spacer profile 3 in the application head but prior to arrival at the part of the application head on which the devices for incision of the portions designed for the corners or cusps of the spacer frame 3 and for final cutting are located. Devices are known that extrude the thermoplastic sealant 6 in the path of the mechanisms that produce the incisions.

It is noted that extrusion of the thermoplastic sealant 6 before the spacer profile reaches the machine for applying it on one of the two glass sheets belongs to the background art of GB 2 045 229, which is not commented here since it is redundant with respect to disclosures of the four mentioned documents.

Main problems, inherent to the known techniques described above are as follows:

several discontinuities of the butyl sealant, because the transitions that occur during the application of the spacer profile on the glass sheet (due to the previous incision of the inside curve of the profile at the regions that will become a corner or cusp and due to the rotation of the head at the corner or cusp) and the transitions or pauses that occur in the transfer of work from one insulating glazing panel to the next force transient conditions also on the process for extrusion of the butyl sealant 6;

criticality of these discontinuities, not only from an aesthetic point of view (which is nonetheless critical especially in the case of structural faces, in which the entire wall of the insulating glazing unit 1 remains visible) but most of all from the functional point of view, the butyl sealant 6 having to meet the requirements of tightness to gas and water vapor; although these are not true interruptions, these discontinuities nonetheless constitute irregularities that are aggravated during the pressing step, since the effect of spreading the butyl sealant on the lateral faces of the spacer profile depends on the uniformity or lack thereof of the thickness and/or shape thereof that was produced during the extrusion step;

even in cases in which the transitions are compensated by means of speed variations or accumulation of the spacer profile, the devices that perform them being located in the same application head, such speed variations and accumulations become excessive in quantity and complex to control, especially since they depend on the length of the sides that constitute the perimeter of the spacer frame 1 and of their succession.

SUMMARY OF THE INVENTION

The aim of the present invention is to solve the above noted technical problems, eliminating the drawbacks of the cited background art, by devising a machine and a method that make it possible to apply the spacer profile 3 on the glass sheet 2 after spreading the second (thermoplastic) sealant 6 onto the recesses (receptacles) 6' of the side walls 3*p*, 3*s* (the first sealant being the adhesive sealant 5) cheaply, functionally and reliably, leading to a qualitative result that is superior to the background art both from a functional point of view and from the aesthetic point of view. The reference numeral 3*p* designates the first wall of the spacer profile 3 that is mated to the glass sheet 2, and the reference numeral 3*s* designates the second one that is mated.

Technical concepts, underlying the claimed invention, all of which differ from those of the background art are:

independence of the process performed by the extrusion machine from the process performed by the application machine (although the two processes continue to be used);

in particular, independence of the modulation ramps of the nozzles for extruding the sealant 6 from the operation for application of the spacer profile 3;

within the limits of a noncritical extension of the perimeter of the insulating glazing unit, uninterrupted extrusion of the sealant 6 for a length that corresponds to the total extension of the perimeter;

within limits that will be described hereinafter, uninterrupted extrusion of the sealant 6 also during the production sequence of several panels made of insulating glazing panels 1.

BRIEF DESCRIPTION OF THE DRAWINGS

Further characteristics and advantages of the present invention will become better apparent from the following detailed description of a preferred but not exclusive embodiment thereof, illustrated by way of non-limiting example in the accompanying drawings, wherein:

FIGS. 1A-1J are schematic views of the peripheral portion of the insulating glazing unit 1 in a non-exhaustive exemplifying series of possible structure combinations of which: FIG. 1A normal; FIG. 1B triple glazing unit with inner glass sheet with coating of the low-emissivity type; FIG. 1C staggered glass sheets, both coated (the inner one with a low-emissivity coating, the outer one of the selective type); FIG. 1D laminated outer glass sheet, inner glass sheet with low-emissivity coating; FIG. 1E tempered reflective outer glass sheet, laminated inner glass sheet with low-emissivity coating.

FIG. 6 differs from FIG. 5 only by the presence of the spacer profile 3, which is shown in the condition of initial application toward the glass sheet.

FIG. 7 incorporates the essence of the inventive concept, since the free roller 608 does not have a feedback function toward a control motor but is itself controlled in position by a control motor. The same figure also designates the upstream assemblies 400, 500 and the downstream assembly 700.

FIG. 16 illustrates the known mechanism for incision of the corners, which is composed substantially of the prism-like blade 215 and of the extractor 216. In particular, FIG. 17 illustrates the known mechanism for the final cutting of the spacer profile 3, which substantially consists of the blade 217. In particular, FIG. 18 illustrates the known final mechanism for pushing the spacer profile 3 toward the glass sheet 2, so that its face 3*p* adheres to the glass sheet, joining it intimately by means of the acrylic adhesive 5; such mechanism substantially consists of a wheel 222 with two diameters (in order to mate with the shape of the regions 6' that is covered by the sealant 6 and 5 coated with acrylic adhesive), pushed by the pneumatic actuator 223, whose pressure is adjustable. The same figure also illustrates the movable jaws 224 and 225 and the fixed jaw 226.

DESCRIPTION OF THE PREFERRED EMBODIMENTS

Figure 1A:
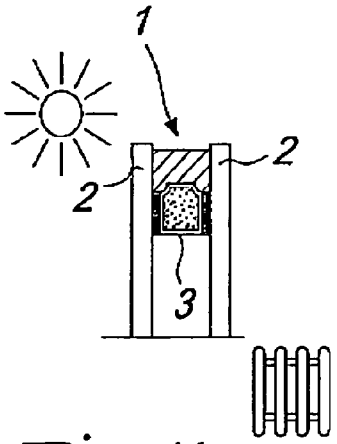
Fig. 1A PRIOR ART
Figure 1B:
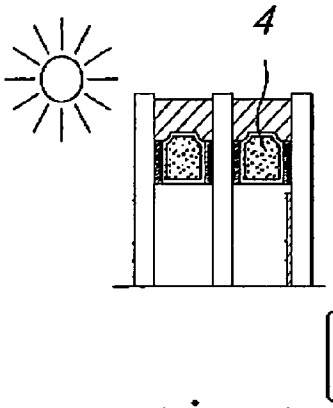
Fig. 1B PRIOR ART
Figure 1C:
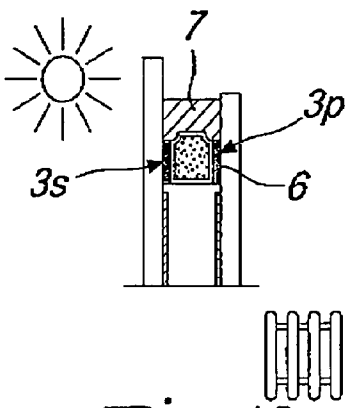
Fig. 1C PRIOR ART
Figure 1D:
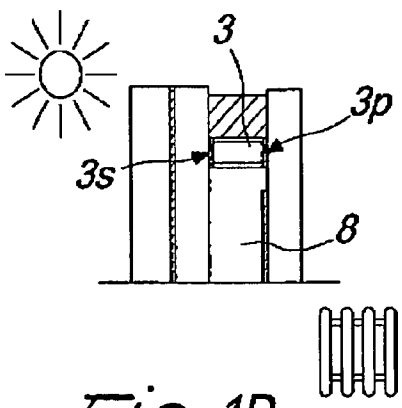
Figure 1E:
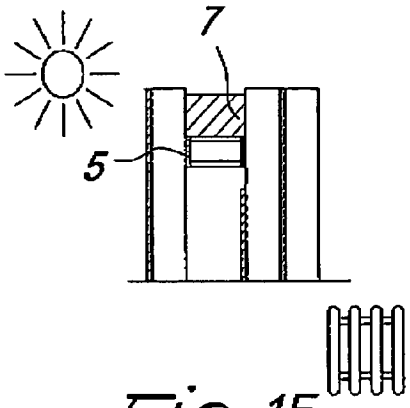
Figure 1F:
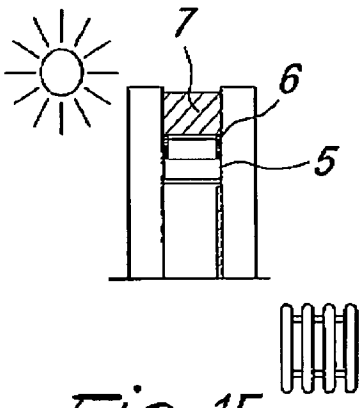
Figure 1G:
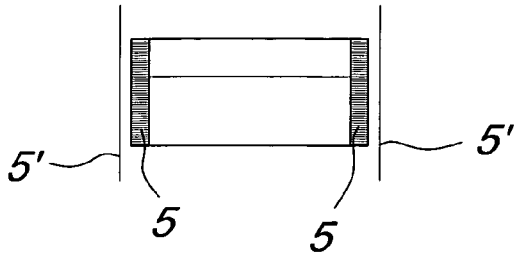
Figure 1H:
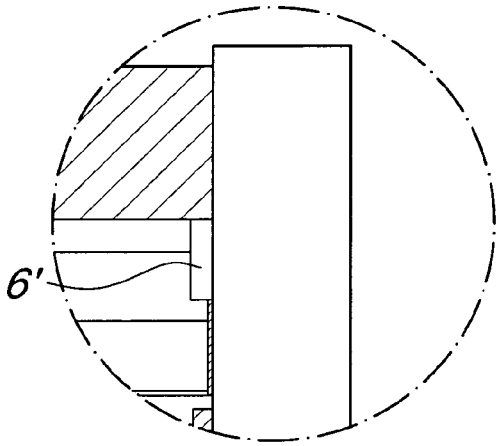
Figure 1I:
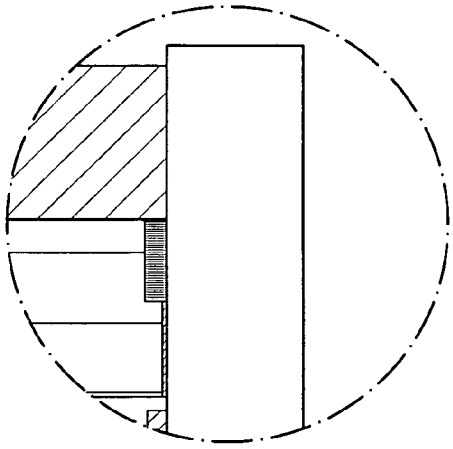
Figure 1J:
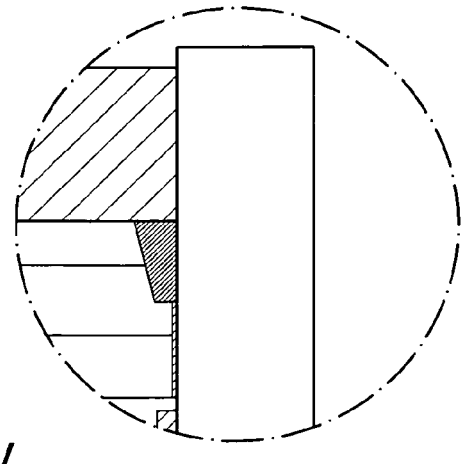
Figure 2:
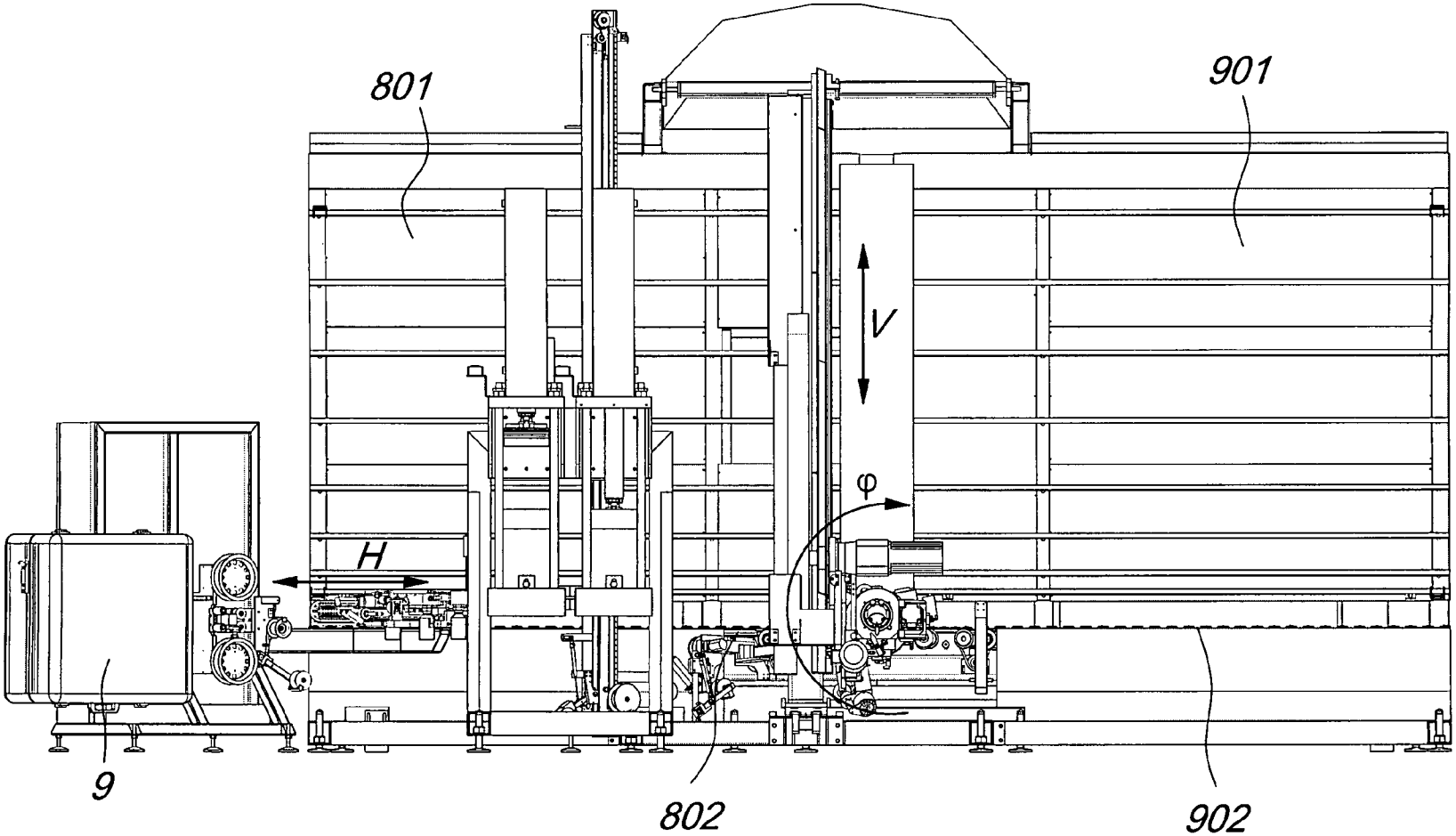
FIGS. 2, 3, 4 are views of the machine that includes the subject of the present invention in its main views (overall front view, with identification of the horizontal axis H, of the vertical axis V and of the rotation axis $\phi$; overall side view of the assembly: vertical runway V with vertical carriage, head 200, melting and pumping assembly 300, unwinding assembly 400; plan view with melting and pumping assembly 300, unwinding assembly 400, extruder of the butyl sealant 500 and inventive part 600).
Figure 3:
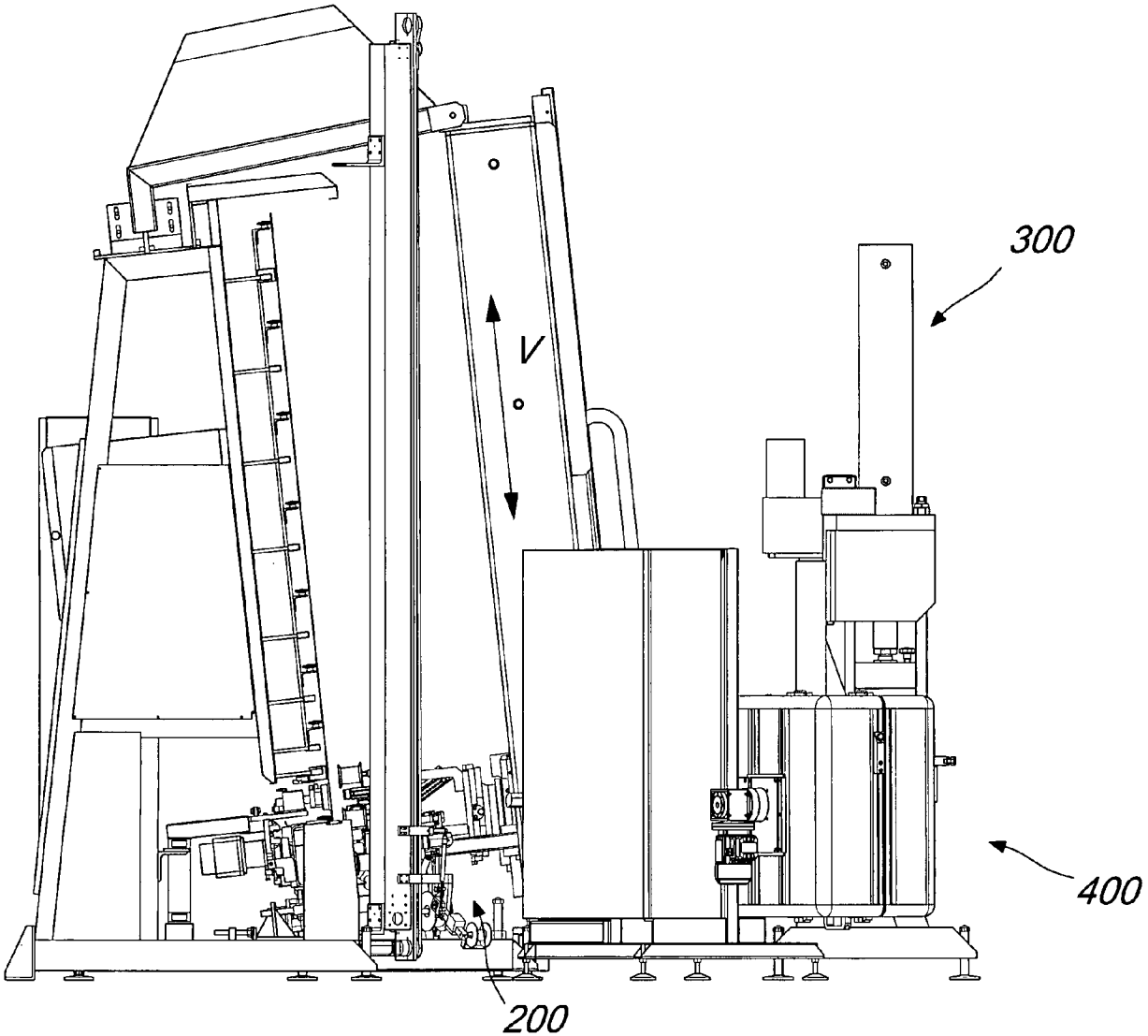
Figure 4:
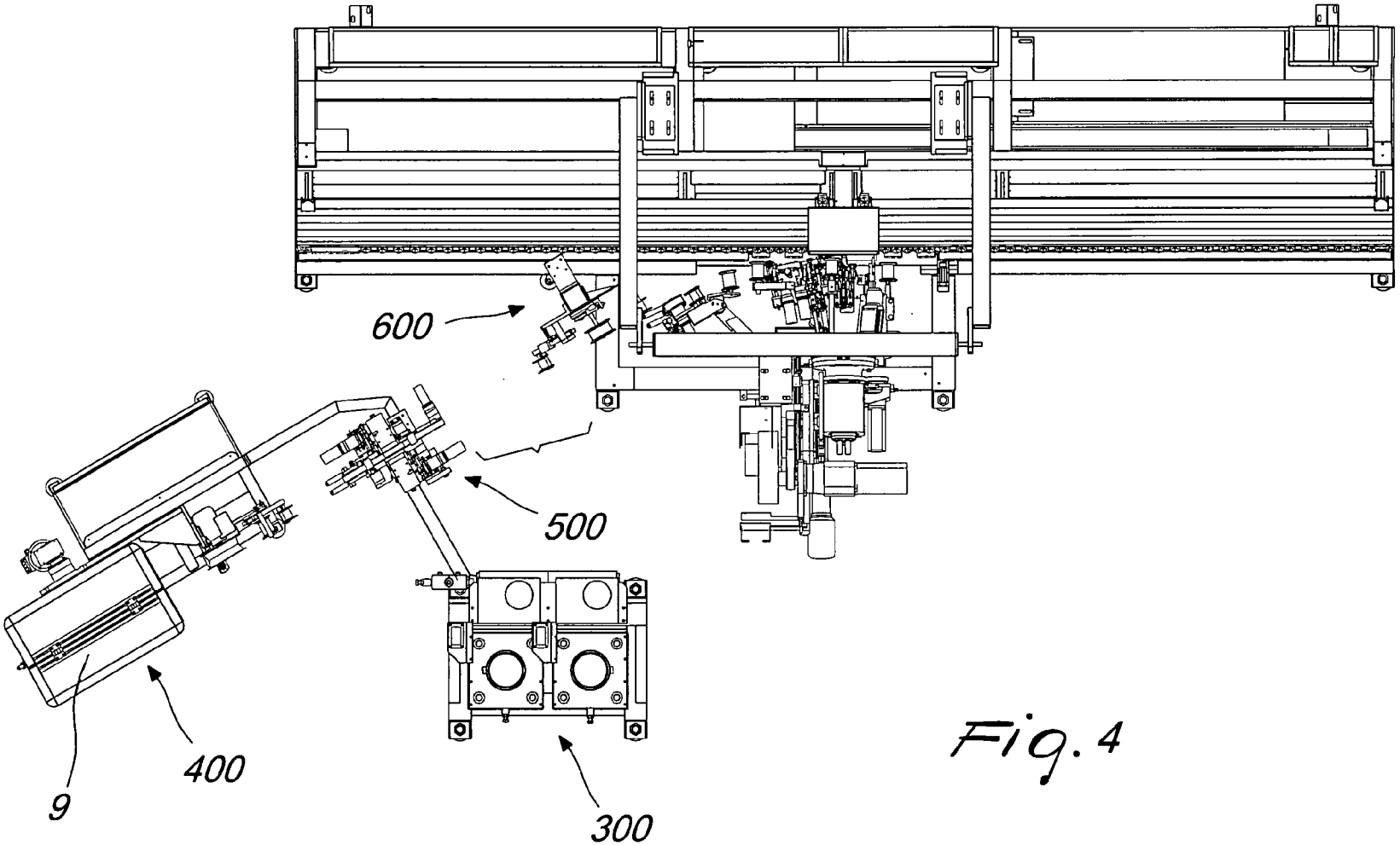

As is shown in FIGS. 1A, 1B, 1C, a traditional spacer frame 3 is made of finely perforated hollow metal or finely perforated hollow plastics containing the hygroscopic material (or desiccant) 4 and illustrate the two types of sealant used: in black, the butyl sealant 6, which acts as an initial bond between the components and as a seal (first seal) and is applied between the lateral surfaces 3*p* and 3*s* of the frame and the glass sheets 2; in hachure, the polysulfide or polyurethane or silicone sealant 7, which has a function of elastic cohesion and mechanical strength (second seal) and is applied between the outer surface of the spacer frame 3 and the faces of the glass sheets 2 up to their edge. FIGS. 1D, 1E illustrate the spacer frame obtained by means of the spacer profile 3 made of expanded synthetic material of the dual seal type, covered with adhesive 5 (first seal), and illustrate the sealant 7 that constitutes the second seal, which is generally obtained with hot melt but also with polysulfide or polyurethane or silicone. In 1D, which again refers to the spacer profile of the dual seal type, the reference numeral 8 designates the gas (which obviously is not visible) contained in the chamber delimited by the spacer frame 3 and by the glass sheets 2 (a gas which of course can be present in all the other FIGS. 1A-1F as well). FIG. 1F illustrates the spacer frame obtained by means of a spacer profile 3 made of expanded synthetic material of the TriSeal™ type, covered with adhesive 5 (first seal) already in its supply condition and spread with butyl sealant 6 (second seal) by means of the device according to the present application and spread with polysulfide or polyurethane or silicone sealant 7 (third seal) in a known machine downstream of the device according to the present application.

The inward/outward orientation is identified visually by means of icons that represent the Sun (outer side) and the radiator (inner side). These FIGS. 1A÷1F show the importance of the spacer frame in the composition of the insulating glazing unit 1, especially in the embodiments in which the thicknesses of the glass sheets 2 and accordingly the weight are substantial (the case of laminated glass sheets), so that use of the spacer profile 3 made of expanded synthetic material, whose lateral faces 3*p* and 3*s* are coated with highly effective acrylic adhesive 5, be it of the "DualSeal" or "TriSeal" technology, turns out to be particularly valid, because it allows the instantaneous coupling of the glass sheets 2 to the spacer 3 already after mating, other than the butyl sealant alone according to the background art with a spacer profile made of metallic material or plastics, in which said coupling is provided, in expectance of the catalytic reaction of the two-part sealant 7, exclusively to the butyl sealant 6, which is thermoplastic and does not bear loads and is subject to viscous flow.

Figure 5:
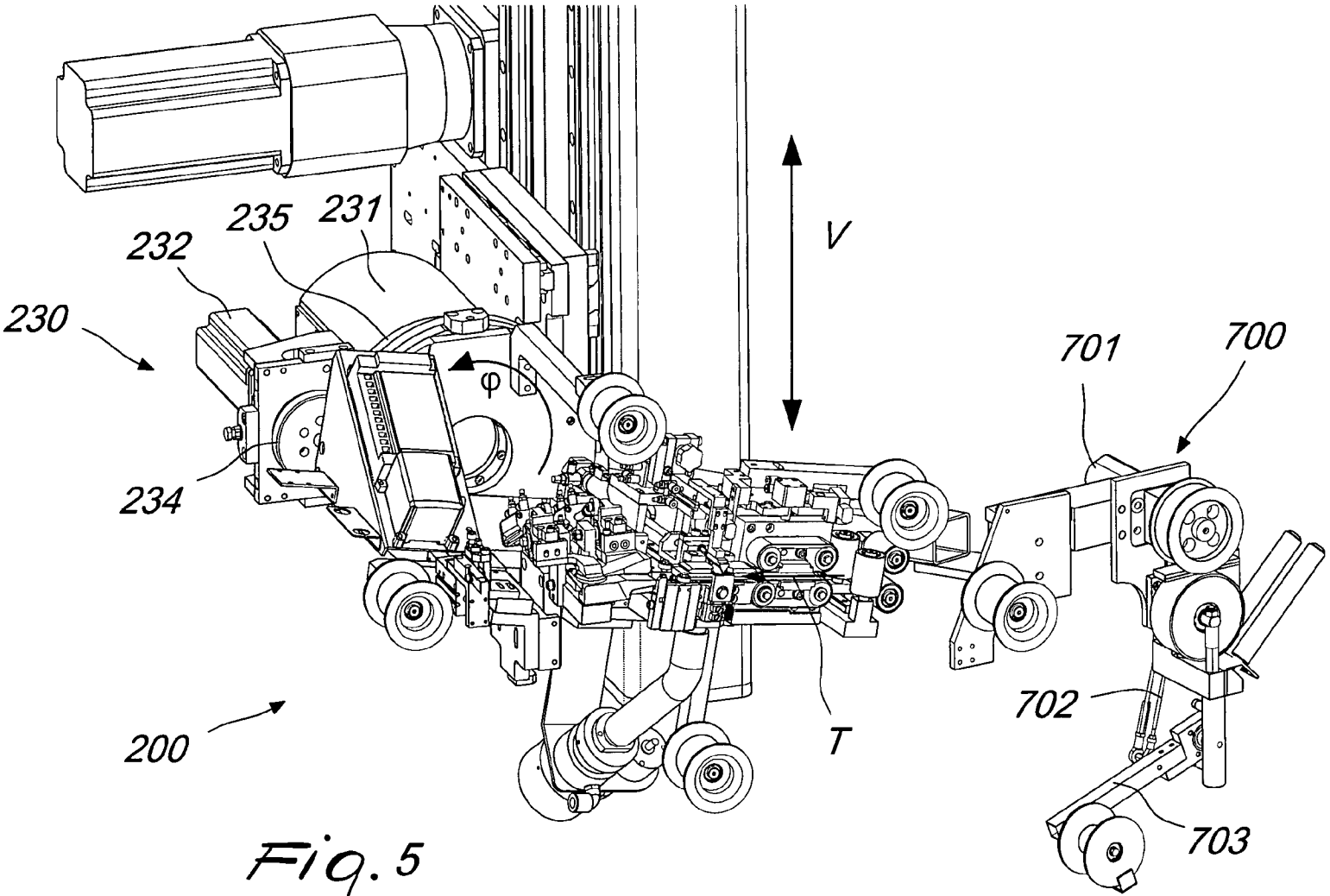
FIGS. 5, 6 and 7 are views of main components of the machine as regards its known part, and specifically the main components divided into groups and the numbering logic: series 100 for the horizontal axis H with a sucker-fitted carriage that operates on the glass sheet 2; series 200 for the vertical axis V with a vertical carriage and subseries 220 for the rotation axis $\phi$ that belongs to the head.
Figure 6:
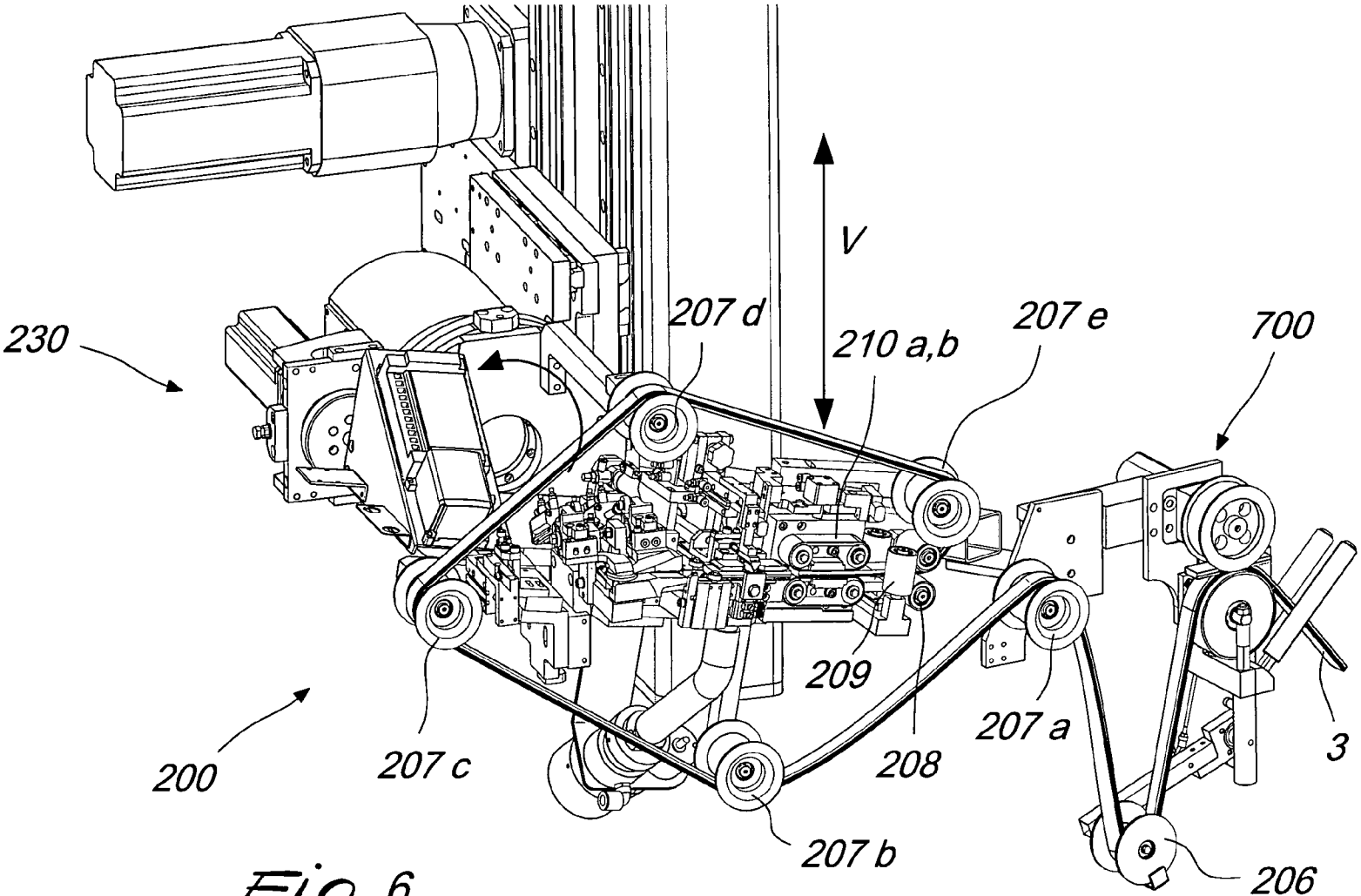
Figure 7:
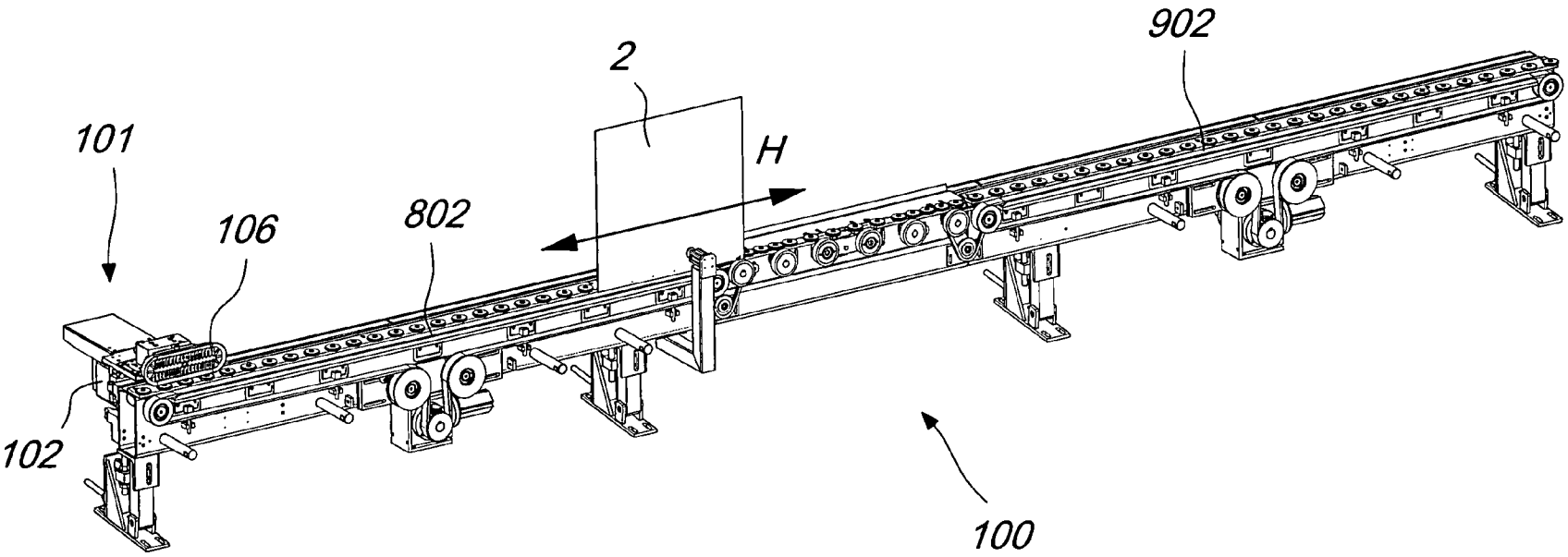
Figure 8:
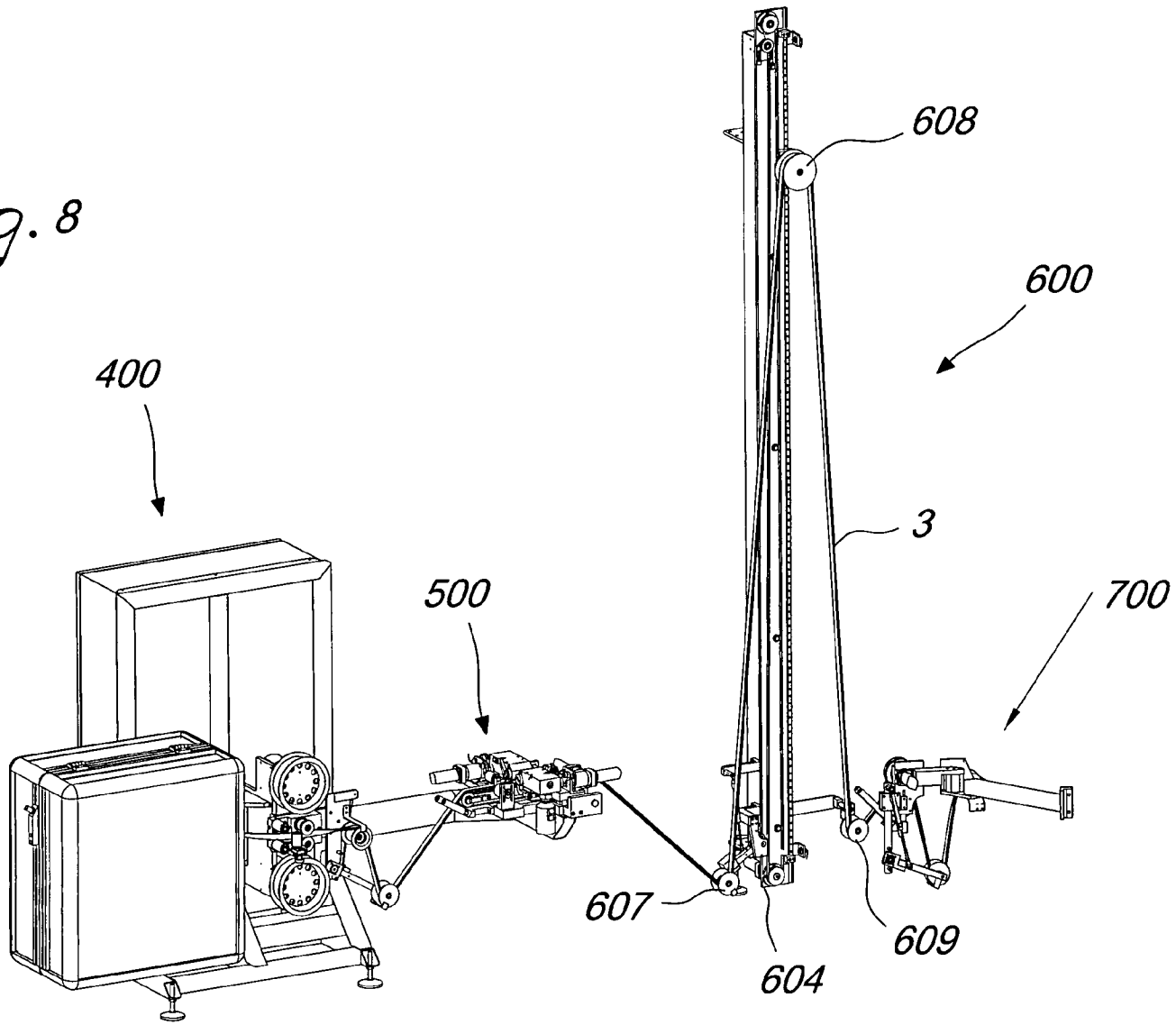
FIG. 8 is a view of the compensation assembly 600 and of the path of the spacer profile 3 in the condition of nearly maximum possible extension. Said figure therefore clearly illustrates the maximum possible accumulation of the spacer profile 3, which is slightly tensioned by winding around the free rollers 607, 608 and 609. This accumulation, whose variability is provided by means of the control logic unit that controls the actuation of the spool ball in the assembly 400 and the logic unit that controls the motor 604, makes it possible to render the extrusion process performed by the assembly 500 autonomous with respect to the application process performed by the head 200 for applying the spacer profile 3.
Figure 9:
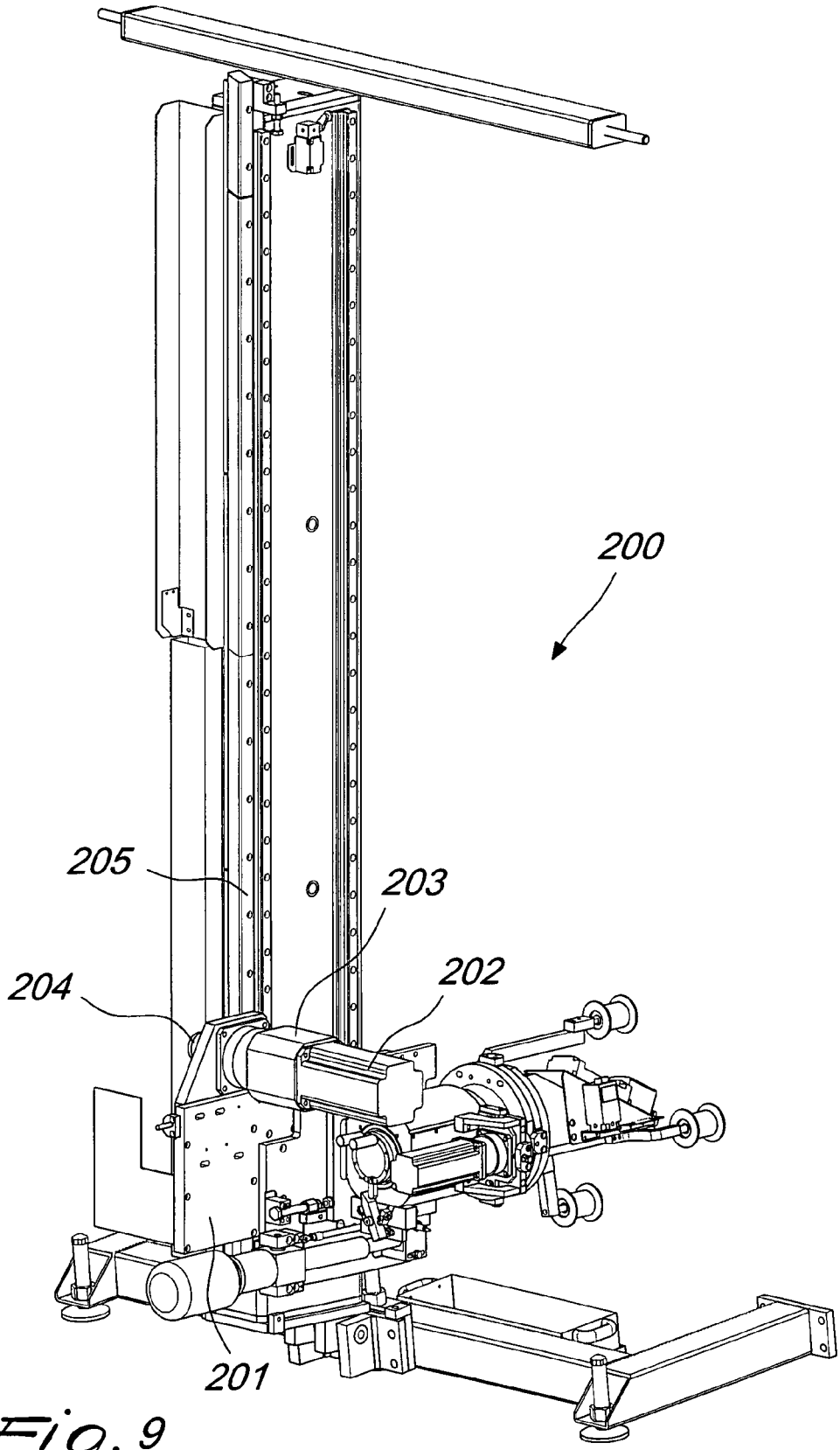
FIG. 9 is an opposite and more extensive view of FIG. 5.
Figure 10:
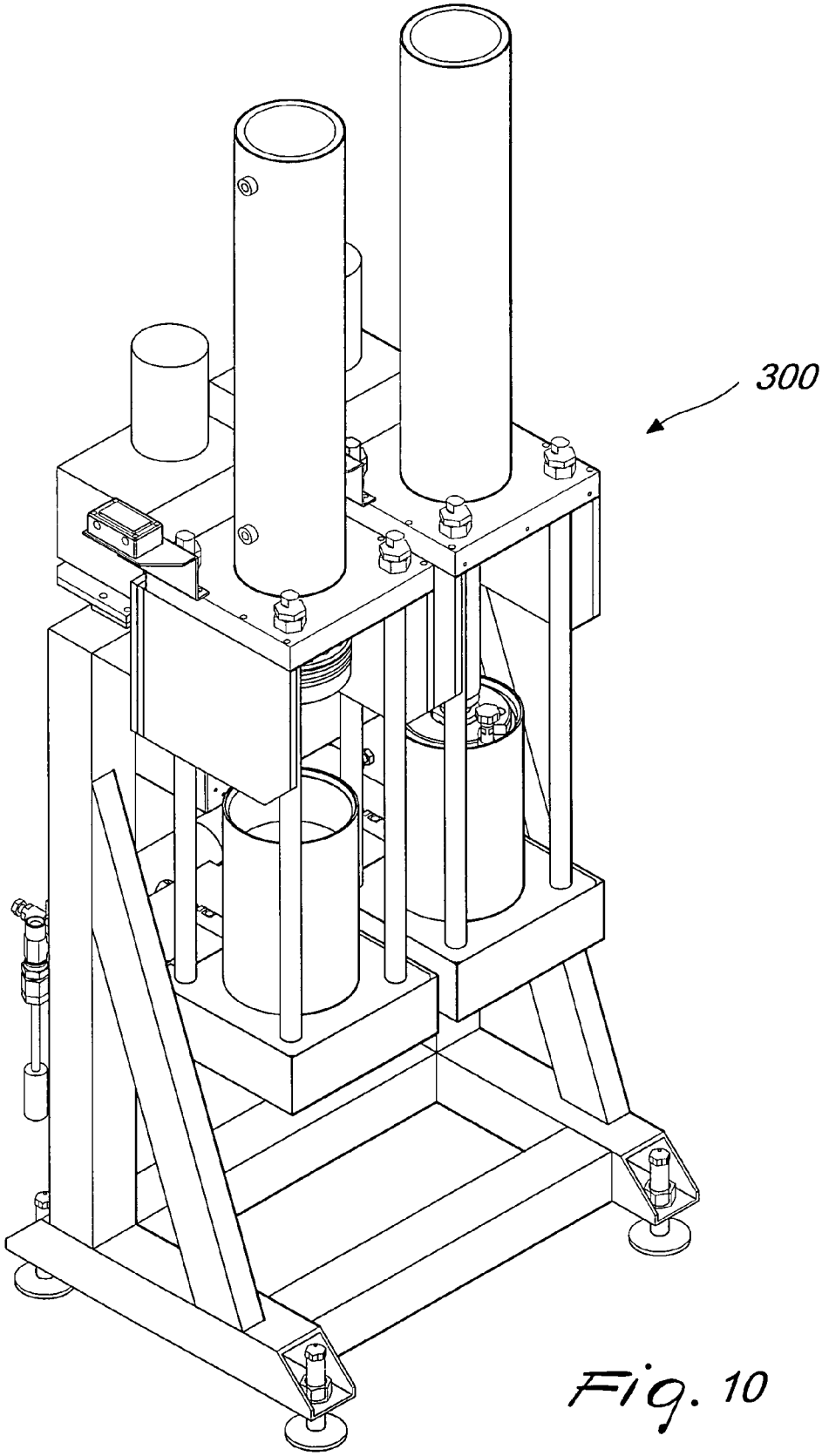
FIG. 10 is an individual view of the series 300 assembly.
Figure 11:
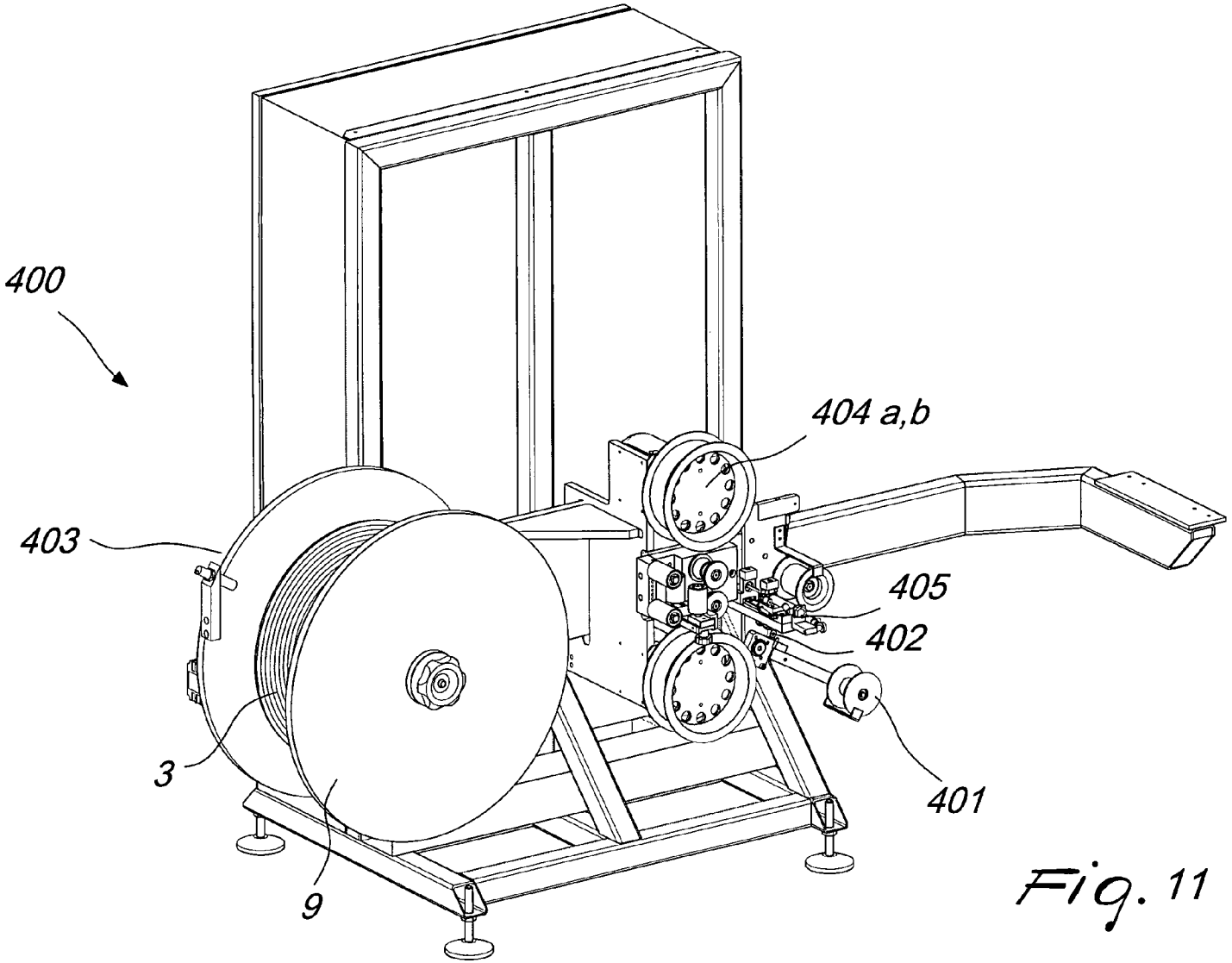
FIG. 11 is an individual view of the series 400 assembly and illustrates its components.
Figure 12:
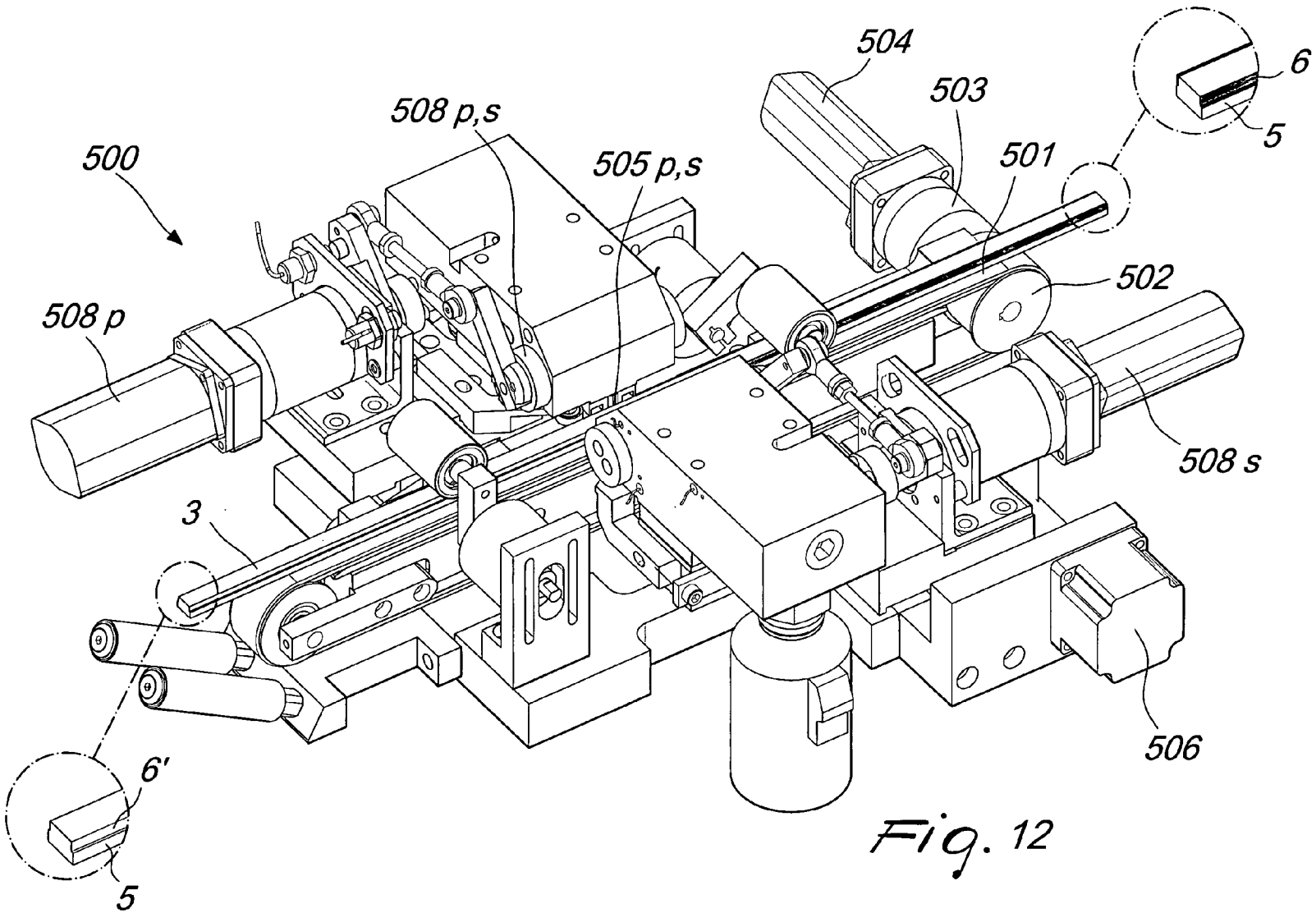
FIG. 12 illustrates individually the series 500 assembly (which is the subject of the present invention together with the assembly 600) and numbers its components, showing the detail of the transformation of the spacer profile 3 as a consequence of passing between the extrusion nozzles 505*p*, 505*s*.
Figure 13:
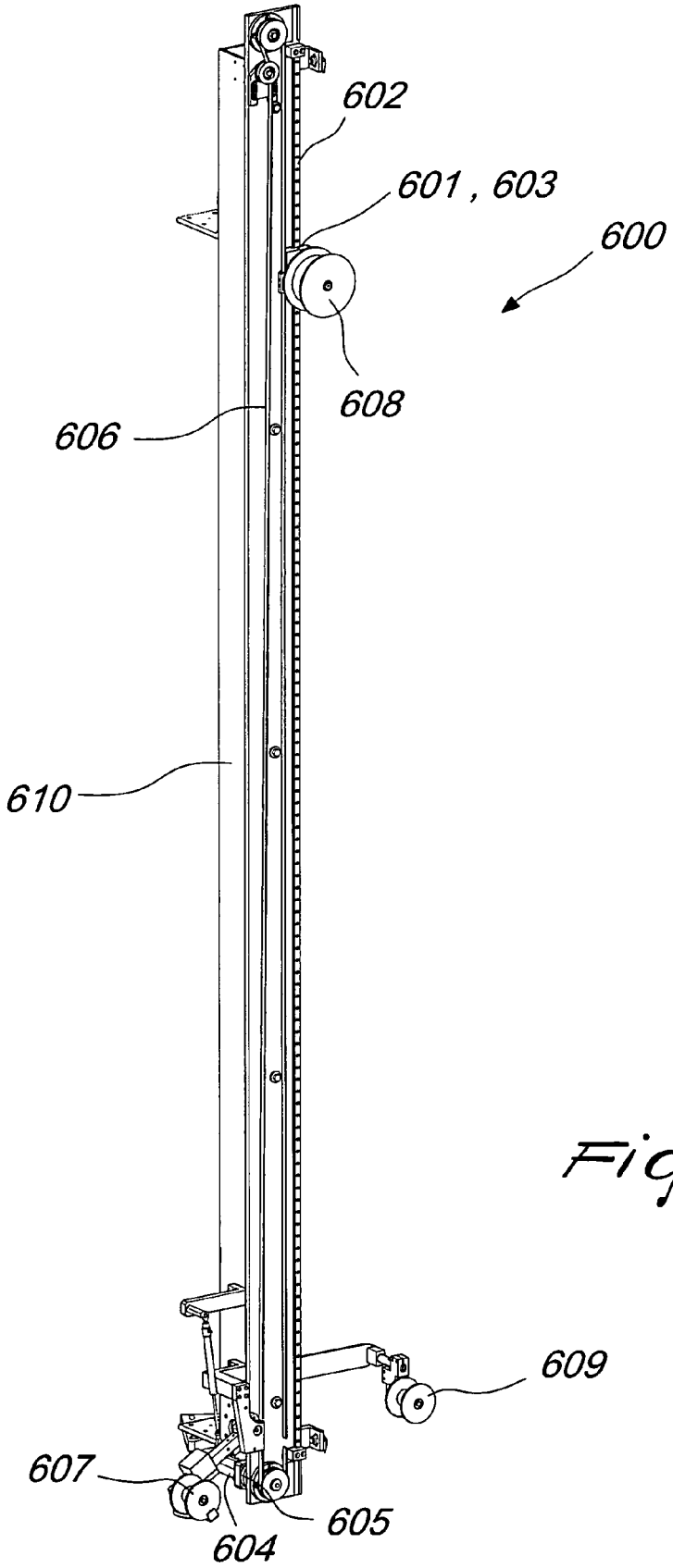
FIG. 13 is an individual view of the series 600 assembly (which is the subject of the present invention together with the assemblies 500 and 200) and numbers its components, in greater detail than FIG. 8.
Figure 14:
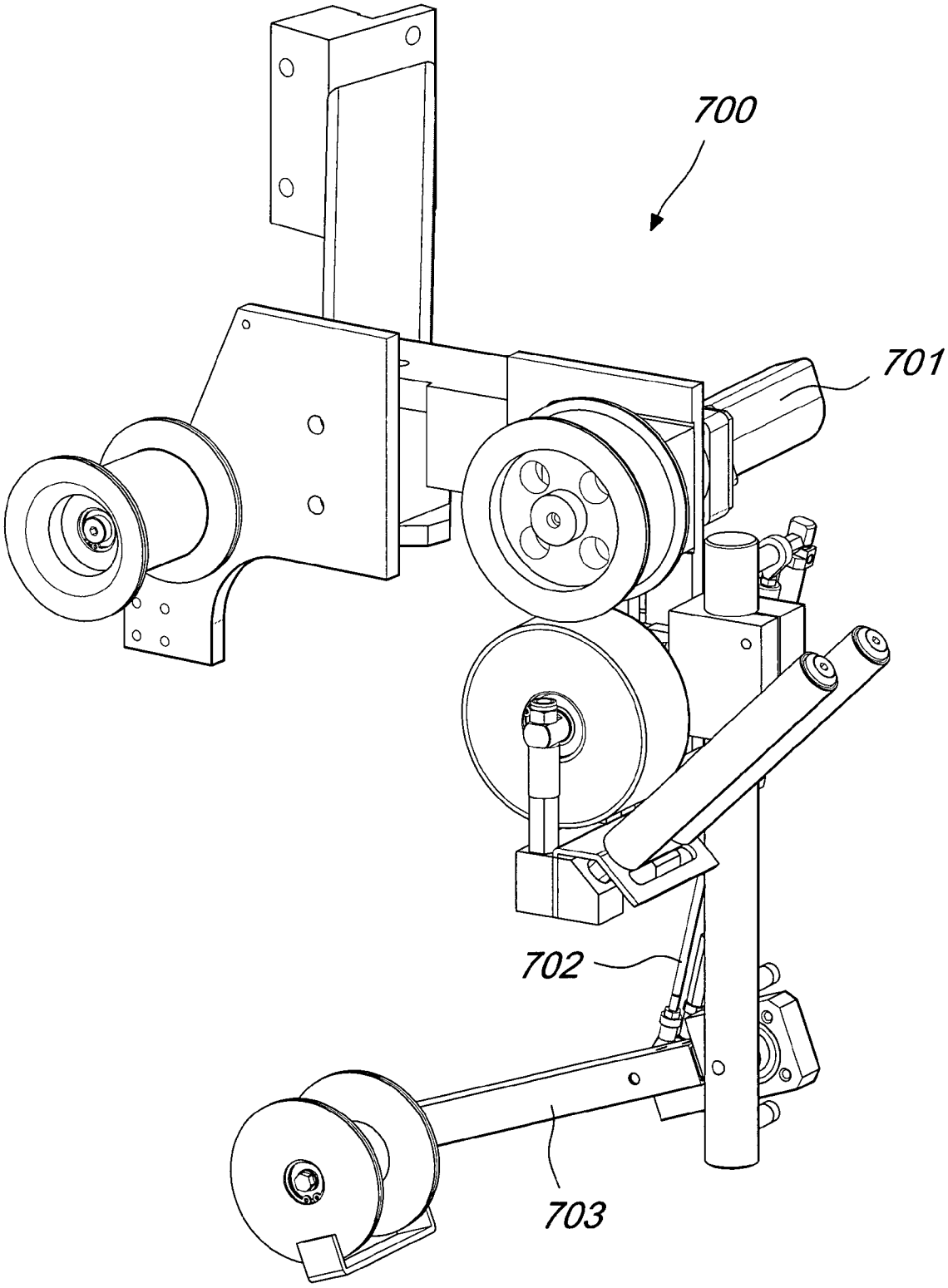
FIG. 14 illustrates individually the series 700 assembly and numbers its components.
Figure 15:
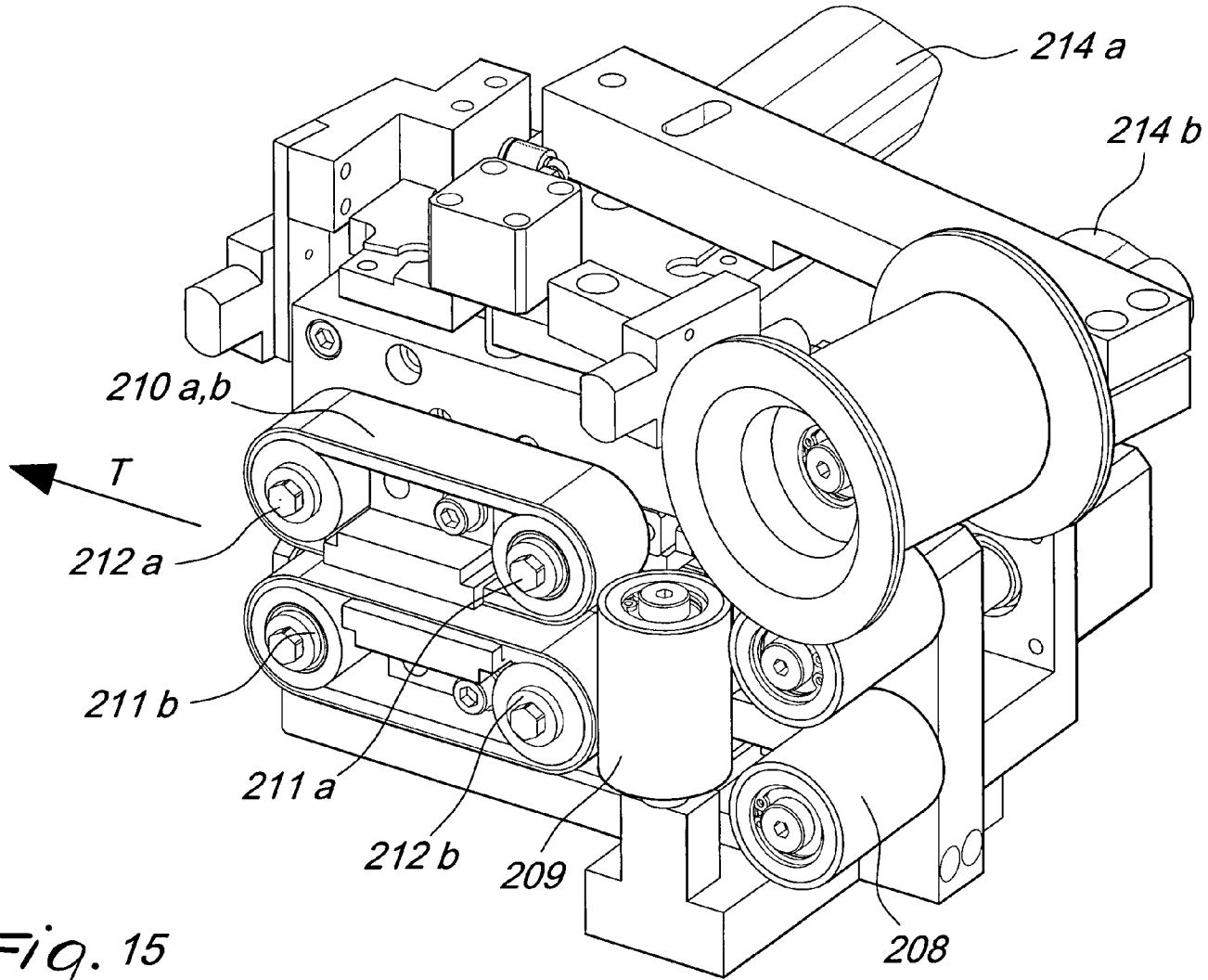
FIGS. 15, 16, 17 and 18 relate to the mechanisms already shown in FIGS. 5 and 6, but are necessary for a clear illustration of the many components. These figures relate progressively to the components of FIGS. 5 and 6 in the succession followed by the spacer profile 3. In particular.
Figure 16:
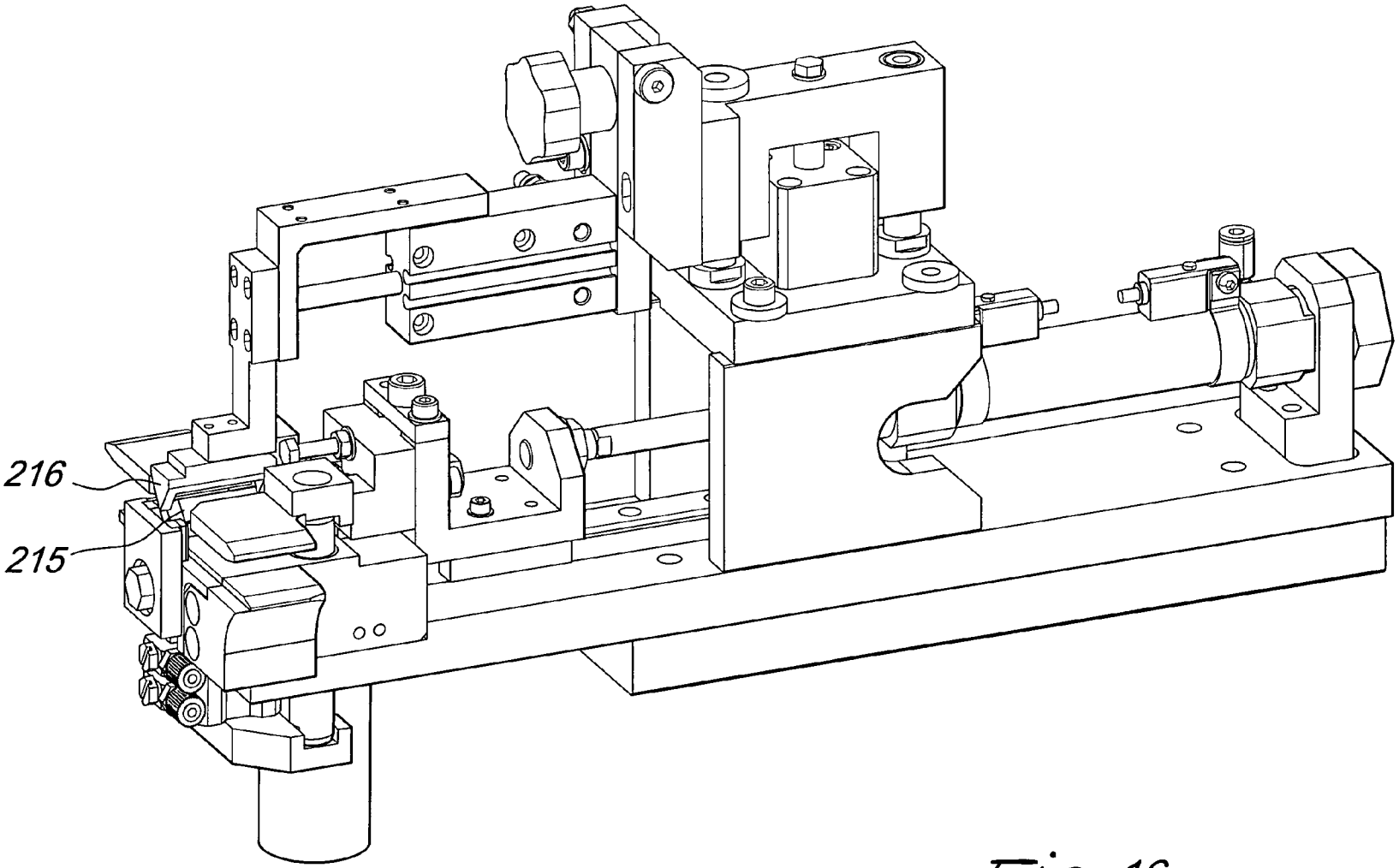
Figure 17:
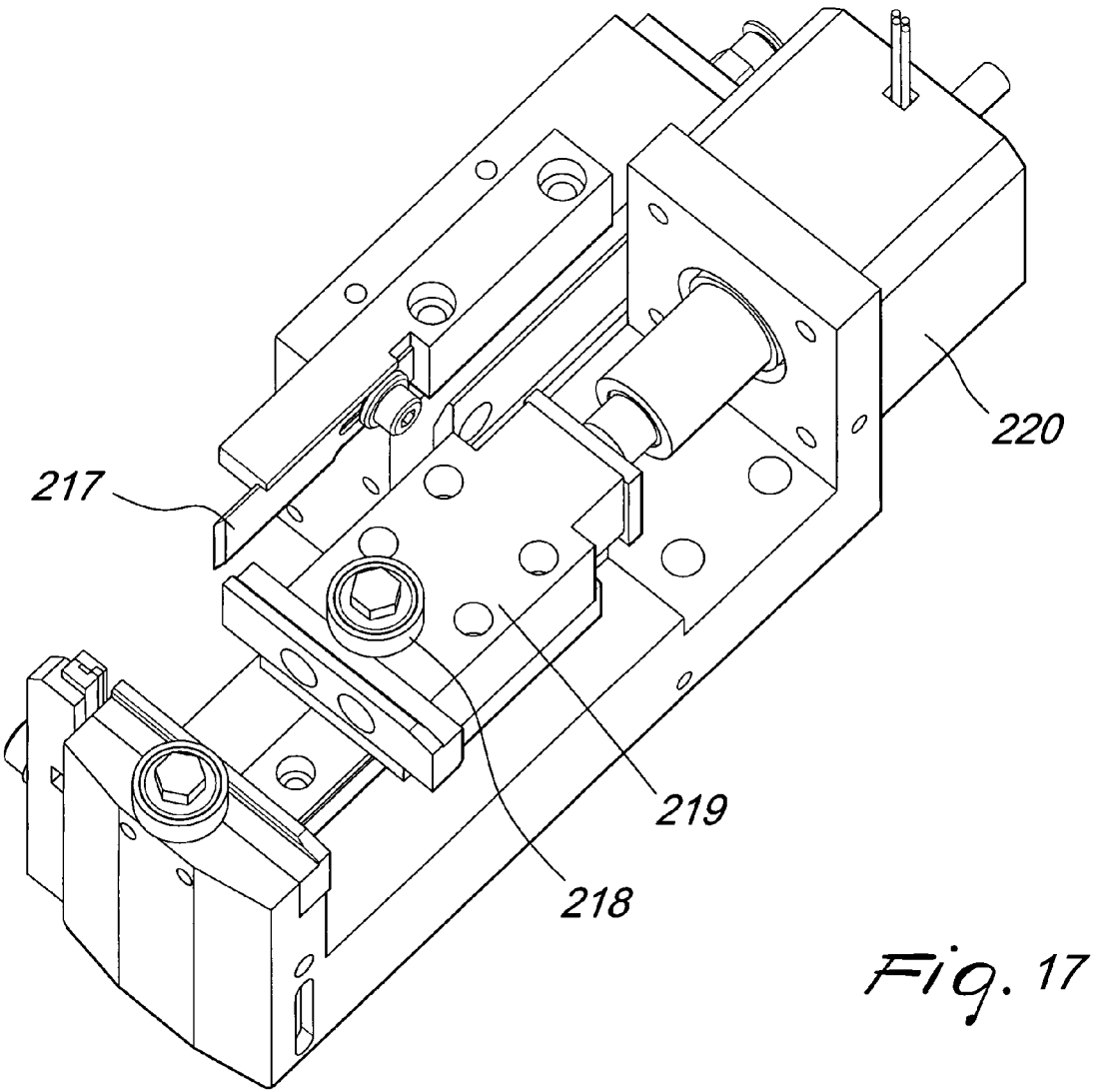

For better description of a preferred but not exclusive embodiment of the invention, which, as the skilled in the art would recognize, is meant to comprise known equivalents, reference is made mainly to FIGS. 2 to 7 and to FIG. 8. In FIG. 8, inventive parts both as regards the machine and as regards the operation are illustrated. FIGS. 5, 6 and 7 regard parts assumed to be known, and which are referred to in the description for completeness.

The numbering below 10 (1 digit) refers to the material being processed, while the numbers with three digits refer to the components of the machine and the numbers that end with two zeros (as already used earlier) refer to each assembly (also referred to as "station" in another part of the description) of the machine. Otherwise, i.e., with a random progressive numbering, the description would be complicated to follow in view of the quantity of components.

In particular, the reference numeral 3 designates the spacer profile made of expanded synthetic material, without excluding operation of the machine also with spacer profiles made of a different material, as long as it is compatible with the mechanisms that will be described hereinafter; the reference numerals 3*p* and 3*s* designate respectively its first (3*p*) and second (3*s*) lateral faces that mate with the glass sheets 2; the reference numeral 2 designates the glass sheets (two, or more in the case of an insulating glazing unit composed of more than two glass sheets); the reference numeral 1 designates the insulating glazing unit as an assembly of the components 2 to 8. These numberings have already been used partly in the preceding chapters, based on the obviousness of such use.

Two digit numbering is also used as follows: the reference numeral 11 designates an electrical/electronic panel; the reference numeral 12 designates a control post and the reference numeral 13 designates protective structures, be they of the type of mechanical barriers or optical barriers or laser barriers or electrically sensitive mats etcetera, since particular attention is given not only to the functional, economic and ergonomic aspects of the content of the present invention but also to the aspects related to prevention of accidents, which is inherently improved with respect to the background art indeed by means of the particular automation that is achieved with the present invention. Four-digit numbering is also used to refer to the machines that belong to the complete production line of the insulating glazing unit 1 and are complementary to the machine designated by the reference numeral 1000, which constitutes the machine that contains the device according to the present invention.

A preferred embodiment of the invention is one described hereinafter. For easy comprehension, it is convenient to follow the figures in parallel, since the listings of the components are numerous and, to the extent to which this is possible, are referred to in the same succession in which they appear in the figures.

A preliminary remark must be considered regarding orientations: when the terms "vertical" or "substantially vertical" are used, it is understood to mean "slightly inclined with respect to the vertical" as defined hereinafter. Transport of the glass sheet in fact occurs on conveyors 801, 901, etcetera, whose supporting surface is inclined by approximately up to 6° with respect to the vertical plane.

Likewise the axis of the lower support/conveyance belts 802, 902 is inclined by approximately up to 6° with respect to the horizontal plane, and therefore "slightly inclined with respect to the horizontal" shall be understood when "horizontal" or "substantially horizontal" are used.

Reference is made first of all to the embodiment of the part of the machine and of the method that is already known, i.e., of all the parts of the conveyor 100 and of the head 200 that apply the spacer profile 3 without applying thereto the second thermoplastic sealant 6, i.e., the parts used in dual seal technology, which does not use the intermediate thermoplastic sealant. It is thus possible to implement the mechanisms and functions for feeding the second thermoplastic sealant related to TriSeal™ technology, to thus understand inventive aspects of the invention.

The glass sheet 2, which originates from the preceding processing machine 4000, in the specific case a washing unit, is either loaded manually or by means of a loading unit onto the inlet conveyor 801 of the machine according to the present invention, advances, carried by the support and traction belts 802, and more specifically (in terms of synchronization between the actuators) by means of a sucker-fitted carriage 101 actuated by a synchronous motor 102 through a mechanical transmission consisting of a reduction unit and a pinion and rack (a transmission which is not visible in FIG. 7 and is not numbered but is known), up to a slowing sensor and to a stop device, both of which are known, so as to position the glass sheet 2 and allow the beginning of the process for applying the spacer profile 3 against the glass sheet 2. Previously, the head assembly 200, which can move vertically because it is applied to the vertical carriage 201, by the action of the synchronous motor 202 and the reduction unit 203, which actuate the pinion 204 that interacts with the rack 205, has been positioned in the process start condition.

The spacer profile 3, guided through the series of free rollers such as 206, 207*a-e*, which are present in FIGS. 5 and 6 and interact with the faces of such profile and whose axes lie approximately at right angles to the plane of the glass sheet 2, through mutually opposite free rollers such as 208, which are also free and present in FIGS. 5 and 6, interact with the faces of the spacer profile, and whose axes are approximately perpendicular to the plane of the glass sheet 2, and through mutually opposite free rollers such as 209, which are also free and present in FIGS. 5 and 6, interact with the faces of the spacer profile, and whose axes are approximately parallel to the plane of the glass sheet 2, said spacer profile gripping the synchronous transmission device with toothed belts 210*a* and 210*b*, the upper one of which floats with respect to the lower one in order to provide a pressing action towards the spacer profile 3 that is controlled by a proportional pressure-controlled switch, which actuate the synchronous motion of the spacer profile 3 along the axis T and run on free pulleys 211*a* and 211*b* and driving pulleys 212*a* and 212*b*, these last being actuated by means of the reduction units 213*a* and 213*b* by the synchronous motors 214*a* and 214*b*, is fed toward the glass sheet 2 respectively along the horizontal axis H when the orientation of the head 200 is such as to arrange the conveyor belts 210*a* and 210*b* so that the face is parallel to the horizontal axis H or along the vertical axis V when the orientation of the head 200 is such as to arrange the conveyor belts 210*a* and 210*b* so that the face is parallel to the vertical axis V or along an inclined direction when the orientation of the head 200 is such as to arrange the conveyor belts 210*a* and 210*b* so that the face is locally tangent to a line that is parallel to the perimeter of the glass sheet 2 and is spaced from it as a function of the desired position of the spacer frame 3 with respect to the edge of the glass sheet 2.

Figure 18:
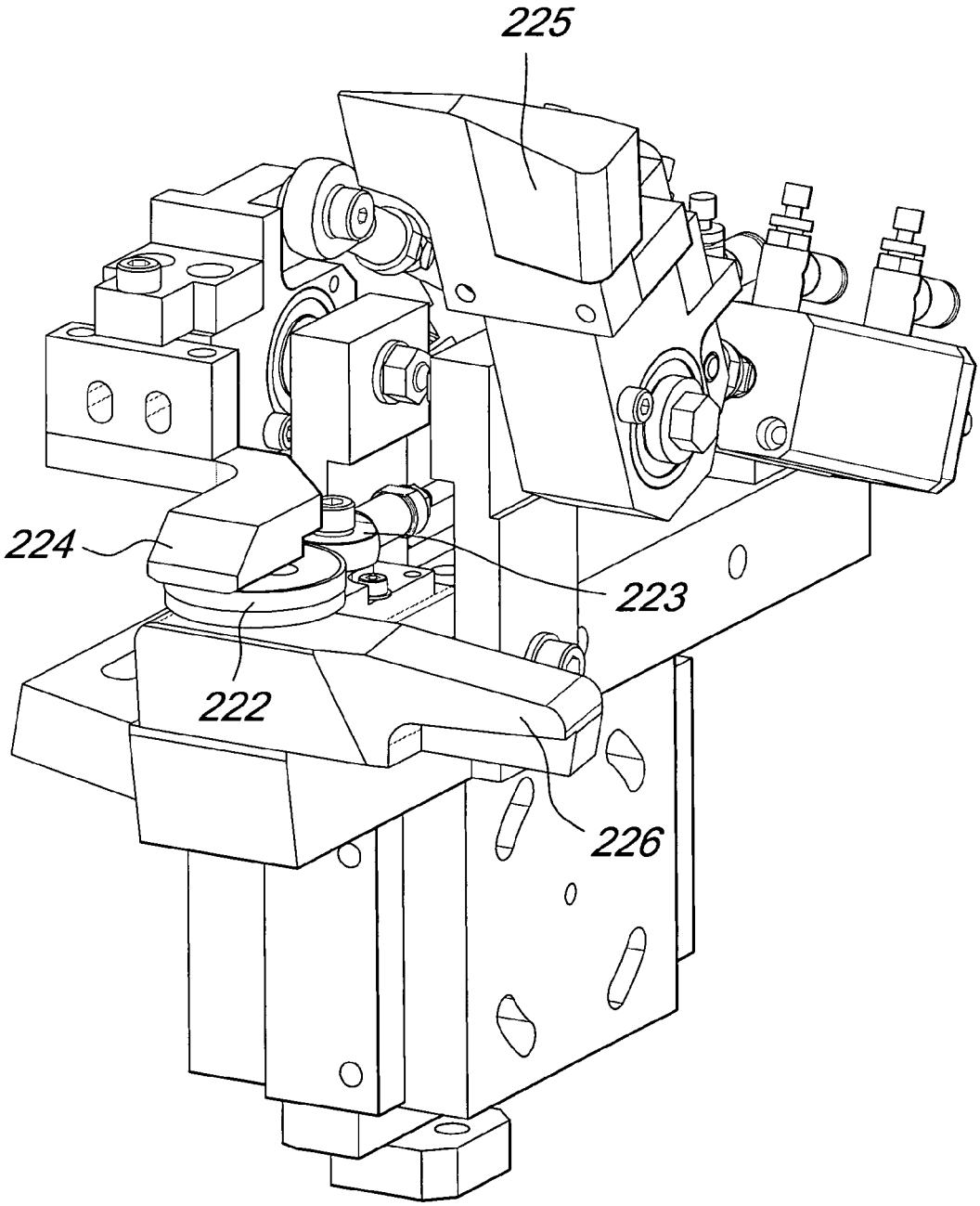
Figure 19A:
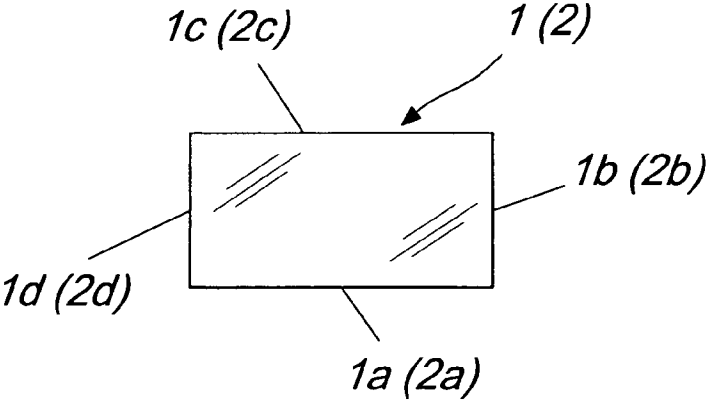
FIGS. 19A-19D illustrate the configurations of the insulating glazing unit 1 in the rectangular versions, with numbering of the corresponding sides, and in non-rectangular versions.

At this point, the synchronized motion of the glass sheet 2, actuated by the synchronous motor 102 that acts by means of the reduction unit and a mechanical transmission of the type with a pinion /rack (the reduction unit, the pinion and the rack not being visible in FIG. 7 but being known) on the sucker-fitted carriage 101 provided with suckers 106 (and by the action of the parallel mechanical belt conveyors 802, 902 consisting of known components which operate on the lower edge of the glass sheet 2, said conveyors actuated by a synchronous motor for maintaining synchronization with the sucker-fitted carriage) and the synchronized motion of the belt transmission device 210*a* and 210*b* cause the tracing of the mutual path of the spacer profile 3/glass sheet 2 that corresponds to the first lower side 2*a* (as defined in FIG. 19A) of the glass sheet 2. For allowing the application of the spacer profile 3 against the glass sheet 2 without the various devices of the head 200 affecting the glass sheet 2, the arrangement of said head is slightly inclined with respect to the plane of the glass sheet 2 and some components of the head 200, such as for example the wheel 218 that operates on the face 3*s* and can move on a slider 219 by means of the action of the actuator 220, for example of the step motor type, are provided with an axial motion, for adapting to the different thicknesses of the spacer profile 3 (thickness being the distance between its faces 3*p*, 3*s*, measured in the station 400 as mentioned hereinafter), and others, such as for example the sliding blocks 224 and 225, can be moved away by known mechanisms for eliminating interference with the spacer profile 3 once it is applied, as shown in FIG. 18. In this step, the spool 9 (designated by a reference numeral in FIGS. 2 and 4, but masked by the enclosure that protects it against contamination by atmospheric humidity, since the spacer profile 3 contains, dispersed within its mass, the hygroscopic material 4), whose rotation is controlled by a known non-synchronous motor which operates by means of a likewise known reduction unit, and likewise known adjustment systems with a dandy roll and a proximity sensor, feeds the spacer profile 3 not so much in step with the activity of the application head 200 but autonomously in step with the apparatus 500 directly downstream of said spool, which performs the extrusion of the second sealant 6. The motor that drives the rotation of the spool 9 is fedback by the position of the dandy roll 401 that interacts with a potentiometer 402. The dandy roll and the potentiometer perform feedback and fine control, while an equally known sensor 403 provides information related to the diameter of the spool for coarse control of the rim speed range of said spool. Also during this step, the films 5' that protect the acrylic adhesive 5 that is spread on the lateral faces 3*p* and 3*s* of the spacer profile 3 are removed conveniently by means of winding reels 404*a*, 404*b*, which are also known and are actuated by respective motors that engage them directly, their electronic actuation being simply of the torque-control type. Equally known probes, which interfere with the films 5', stop the machine in case of breakage or other malfunctions that affect said films. Under these conditions, omitting for the time being the operations performed by the mechanisms of the assemblies 500, 600 and 700, the spacer profile 3 is guided to the glass sheet 2 at its lower horizontal side up to its end. A thickness measurement device 405 that belongs to the section 400 provides the thickness parameter to the mechanisms of the head 200 that must adapt to the thickness of the spacer profile 3. Then motion along the horizontal axis H is stopped and by the action of the actuation means 230 (which consists of: support 231, motor 232, reduction unit 233, pinion 234 and ring gear 235) that actuate the rotation of the head 200 [along ±ϕ], said head performs a 90° rotation; then the head 200 is activated in its vertical motion V by the translation actuation means 201 (which consist of: vertical slider 201, motor 202, reduction unit 203, pinion 204 and rack 205). The spacer profile 3, guided through the toothed belts 210*a* and 210*b*, that constitute traction means for the synchronous traction of the profile 3 traces the path that corresponds to the first vertical side 2*b* (the numbering of the sides being the numbering of FIG. 19A). It is intuitive to deduce the continuations of the path of the remaining sides 2*c* and 2*d* of the glass sheet 2 as repetitions of the preceding steps.

Control of the position of the glass sheet 2, in particular of its initial position, is fundamental for the correct operation of the process performed by the head 200, both in the rectangular version and in particular in the contoured version, for coordinating the horizontal movements H of the glass sheet 2 and the vertical movement V of the vertical carriage 201 that carries the head 200.

In the case of a glass sheet 2 that has a rectangular shape, a sensor (which is known and therefore not shown) detects the position of the edge of the glass sheet and, by means of the logic control of the PLC (programmable logic controller), provides the information, related to the beginning and the end of the sides of the glass sheet 2, respectively to the actuation systems of the transfer belts 802 and 902, of the sucker-fitted carriage 101 along the axis H (and/or to the actuation system of the vertical movement of the vertical carriage 201 along the axis V) and the actuation system of the belt transmission device 210*a* and 210*b* along the axis T.

In the case of a glass sheet 2 that has a contoured shape, i.e., a non-rectangular shape, the information related to its shape, optionally detected by means of scanners or video cameras, is entered electronically by means of known methods (keyboard, floppy disk, net, etcetera) and in addition to the actuation systems described above, which operate on the synchronous motors for actuating the traction systems 802, 902, on the synchronous motor 101, on the synchronous motor 201, on the synchronous motors 214*a* and 214*b*, the actuation of the synchronous motor 232 also is involved, so that the four motions: the horizontal motion H of the glass sheet 2, the vertical motion V of the head 200, the translational motion T of the belts device, the rotary motion ϕ of the head 200, are linked electrically/electronically for following the shape of the glass sheet 2 in the distribution of the spacer profile 3.

Up to this point, the operation and the mechanisms of the part of the machine that feeds the spacer profile 3 toward the glass sheet 2 (related to the application of the spacer profile 3, either provided only with acrylic adhesive 5 or comprising both the acrylic adhesive 5 and the butyl sealant 6, if the latter is already present as supply condition of the profile) have been described. Further it is described the method of extrusion and application of the butyl sealant 6 in the receptacles 6' with which the spacer profile 3. That, in combination with the above description forms an example of a possible complete method of operation and a complete set of devices.

The following apparatuses are arranged respectively upstream of the application head 200: the melting assembly 300, the unwinding assembly 400, the extrusion assembly 500, the compensation assembly 600 and the traction assembly 700, the latter being however jointly connected to the application head 200.

Respectively, these apparatuses (300 and 400 of a known construction) perform the following processes: [300] melting of the butyl sealant 6 (but not exclusively limited to butyl sealant); [400] controlled unwinding of the spool 9 that contains the spacer profile 3 provided with receptacles 6' and removal of the protective films 5'; [500] symmetrical and controlled extrusion of the sealant 6 on the receptacles 6'; [600] compensation of the offsets between the extrusion process and the application process (said compensation is described hereinafter in the inventive part of the present application); [700] traction from the compensation apparatus to the application head.

According to a preferred but not exclusive operation flow, these apparatuses are composed as follows:

melting apparatus 300: as known and described in IT-TV2008A000047 and in all the background art related to machines built in the field of the production of spacer frames and/or profiles 3, whether made of rigid material or flexible material, and therefore any description is superfluous.

unwinding apparatus 400: as known and described in EP 1 650 396 and with a thickness measurement device 405, which has already been described.

Parts constituting main but not exclusive inventive aspects of the present invention with reference both to device and to the method are, assembly by assembly, as follows.

extruder 500: substantially comprises what is taught in IT-TV2008A000047 and known machines built in the field of the production of spacer frames and/or profiles 3, whether made of rigid material or of flexible material, it is therefore mainly composed of:

- a synchronous conveyance system, consisting of a transmission belt 501, actuated by means of a pulley 502, a reduction unit 503 and a motor 504, on which the spacer profile 3 is conveyed, resting with its inside curve, in combination with the action of free contrast rollers which operate on the outside curve by means of a force that is pneumatically adjustable by mechanisms that are also known;
- two nozzles 505*p*, 505*s*, toward which the molten and thermostatically controlled thermoplastic sealant is conveyed along a path that branches from the melting apparatus 300;
- at least one actuator 506 for adjusting the mutual position of the nozzles;
- two flow control elements 507*p*, 507*s*, of the type with a spool or needle or profiled plug, actuated by means of a known kinematic chain by the synchronous actuators 508*p*, 508*s*.

An important aspect of the inventive method provided comprises a management of such device, which is independent of the upstream and downstream processes and in particular is independent of the process for applying the spacer profile 3 on the glass sheet 2, so as to optimize the extrusion and distribution of the thermoplastic sealant 6 in the receptacles 6' of the spacer profile 3. Achieving this characteristic can not only cover the steps of complete production of an insulating glazing unit 1 but can even extend to the production of multiple insulating glazing units 1 up to the total depletion of the spacer profile 3 contained in the spool 9. This occurs exclusively in relation to the peculiarities of the insulating glazing units to be produced, the production speeds and the production pauses, and can in any case be performed by operating on the extension of the operating range of the device described in the subsequent assembly 600.

Up to now, a method of operation and the corresponding mechanisms/actuation systems/controls/drives of two entities, each of which operates as a function of the optimization of its own process, have been described. The application apparatus 200 and the extrusion apparatus 500 (fed by the unwinding assembly of the spool 9 complete with reels for removing the protective films 5') are as described earlier.

An inventive aspect of the process and of the machine according to the present invention comprises components interposed between the series of assemblies 300, 400, 500 and the assembly 200, namely:

compensation assembly 600: in summary, comprising a carriage 601 that can move on a linear guide 602, which is arranged vertically, by means of sliding blocks with ball bearings 603*a*, 603*b*, whose positioning is actuated by means of the motor 604, the reduction unit 605 and the belt drive, generally designated by the reference numeral 606. The free roller 608, arranged on the carriage 601 together with two likewise free contrast rollers 607 upstream thereof, acting as a probe with feedback on the speed of the assembly 500, and 609 downstream thereof, said contrast rollers being located at the base of the structure 610 that contains the linear guide 602, determines the path, variable in its linear extension, of the spacer profile 3 between the station 500 for extruding the sealant 6 and the station 200 for applying the spacer profile 3.

This variability of extension, organized on two branches of the path and controlled by the actuation of the motor 604, makes it possible to disengage the extrusion process performed in the assembly (or station) 500 from the application process performed in the assembly (or station) 200, to the point of making the former continuous despite the discontinuity of the latter. Exclusively as a function of the extension of the linear guides 602 and of the speed of the transmission belt that is actuated, by means of the kinematic system consisting of the pulley 502, the reduction unit 503 and the synchronous motor 504, it is thus possible to achieve independence of the processes in the possible configurations described hereinafter.

The quantity of spacer profile 3 that is unwound from the spool 9 in the section 400 and coated with butyl sealant 6 in the station 500 must on average correspond to the quantity of spacer profile 3 that is used by the application head 200 and corresponds to the extension of one or more perimeters of the spacer frame 3 used in the manufacture of the insulating glazing unit 1. However, this does not mean that the instantaneous flow of the spacer profile 3 in the two processes performed by the apparatus 500 and by the apparatus 200, respectively, must be the same.

In particular, all the transient conditions that are typical of the application apparatus 200, such as: the transition for stopping at the end of the horizontal side, the transition for stopping at the end of the vertical side, the transition for the rotation of the head with corresponding initial acceleration ramp and final deceleration ramp, the transition for incision with the devices 215 and 217 with corresponding deceleration ramps for stopping and acceleration ramps for restarting, the transition for not requesting spacer profile 3 between the evacuation of the part of the insulating glazing unit 1 consisting of the glass sheet 2 and of the spacer frame 3 applied in its face 3*p* and the reception of the subsequent part of insulating glazing unit 1 consisting of the glass sheet 2 if they require the upstream process of extrusion of the sealant 6 on the faces 3*p* and 3*s* of the spacer profile to work in step with said transitions, this would entail either the adaptation of the process performed by the apparatus 200 (which is typically discontinuous) to the process performed by the apparatus 500 (which is preferably and advantageously continuous), which is difficult, or the adaptation of the process performed by the apparatus 500 (which is preferably and advantageously continuous) to the process performed by the apparatus 200 (which is typically discontinuous but, worse still, is interrupted by continuous stops and restarts), which is easier but disadvantageous, since it would involve the hot extrusion of butyl product, which is typically non-Newtonian. A non-Newtonian fluid is in fact difficult to control in transitions, especially if they are particularly sudden, because its viscosity varies with the flow-rate, and the flow-rate in extrusions, in addition to depending on the degree of throttling of the valves and on the pressure variation, depends on the viscosity (an algorithm which is therefore very complex if not unsolvable). Typically, the background art in the field uses the second solution, which applies for the present invention also, with the advantageous difference that the present invention allows at least three new possibilities with respect to the background art:

- limiting the stops/restarts of the extrusion performed by the assembly 500 only to the transition from one insulating glazing panel 1 to the next;
- limiting the stops/restarts of the extrusion performed by the assembly 500 only to the transition from one group of insulating glazing panels 1 to a subsequent group;
- absence of stops/restarts of the extrusion performed by the assembly 500 throughout the production of insulating glazing units 1 that uses the same spool 9 of spacer profile 3.

In particular, this third possibility is highly advantageous, since in the background art forced stops/restarts, even during processing of the individual insulating glazing panel 1, are instead occurring.

All these possibilities are achieved by introduction of the compensation assembly 600, which is different from the dandy roll according to the background art and of the type of those used in the assembly 400, at the beginning of the assembly 600 and in the assembly 700, whose position interacts with actuators that modify the flows of material upstream or downstream of said dandy roll. This compensation assembly in fact acts with an opposite logic, which is to accumulate/return all the material that derives from the difference of the flows of the processes upstream and downstream thereof; respectively. This is, therefore, an important inventive concept underlying the invention, that has never been adopted so far in the known art that has developed in the extrusion of thermoplastic sealant on a spacer profile 3 and the corresponding application on a glass sheet 2 for forming an insulating glazing unit 1 with TriSeal™ technology.

traction assembly 700: is a device that is interposed between the compensation assembly 600 and the head 200 and is adapted to return to the compensation assembly 600 the demand for spacer profile 3 or the return due to excess of the spacer profile 3. This is achieved by means of the synchronous actuator 701 and the signal of the potentiometer 702, controlled by the dandy roll 703, which interact with the actuator 604 that determines the position of the roller 608.

Figure 20:
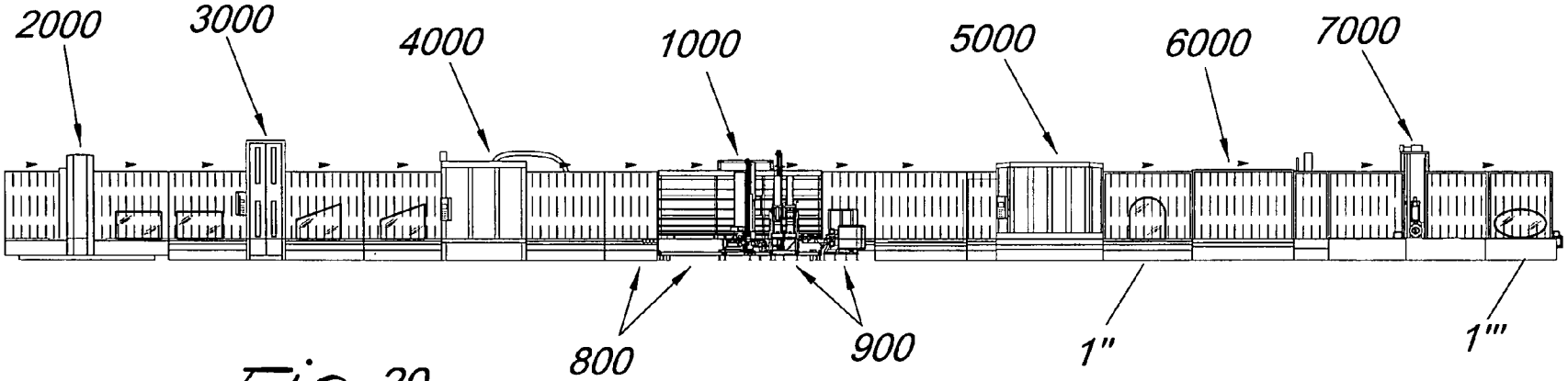
FIG. 20 is a view of an example of insertion of the machine that contains the devices according to the present invention in the line for the production of the insulating glazing unit 1 (perspective view) and does not comprise: the electrical/electronic panel, the control post and the protection devices. Said figure introduces the series 800 numberings for the part upstream of the main part of the machine and the series 900 for the part that is downstream of the main part of the machine containing the devices according to the present application.
Figure 21:
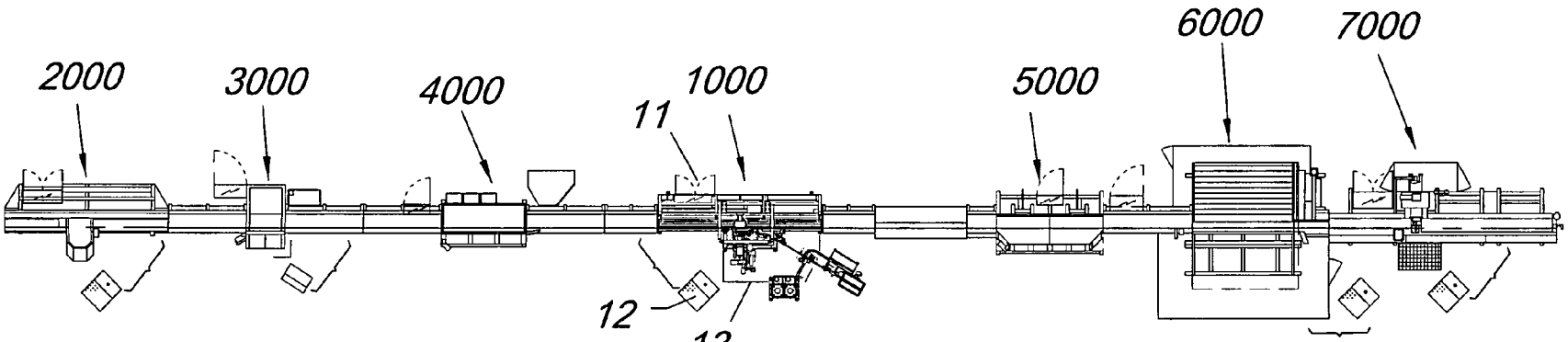
FIG. 21 is a view of an example of the insertion of the machine that contains the devices according to the present invention in the line for the production of the insulating glazing unit 1 (plan view) and includes: the electrical/electronic panel 11, the control post 12 and the protection devices 13.
Figure 22A:
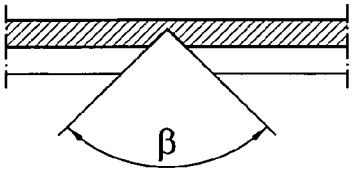
FIGS. 22A-22F are views of the spacer frame, which is composed of the spacer profile 3 made of expanded synthetic material, and its details, such as the corners, cusps, and connecting points after incision and after bending.
Figure 22B:
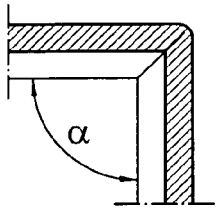
Figure 22C:
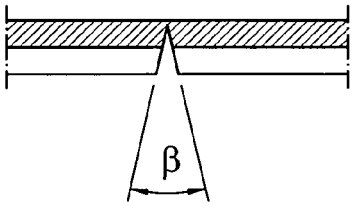
Figure 22D:
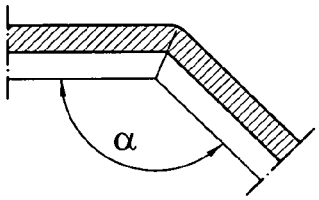
Figure 22E:
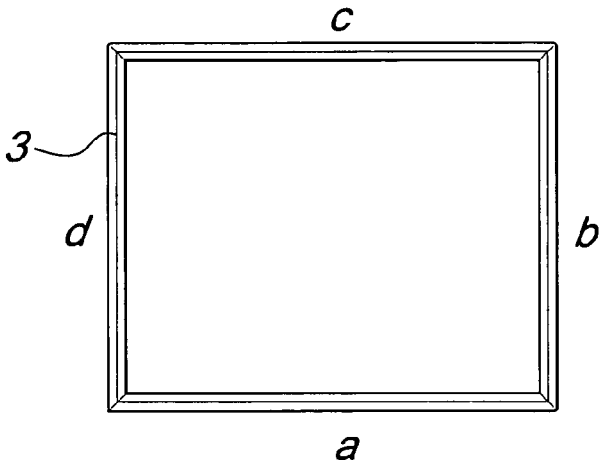
Figure 22F:
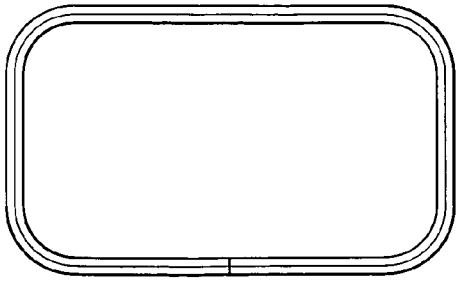
Figure 23A:
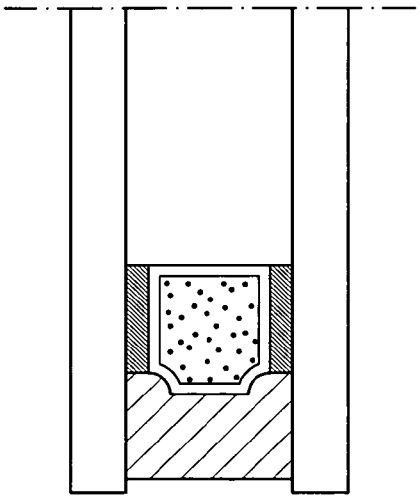
FIGS. 23A, 23B and 24A, 24B illustrate the comparison of the way of operating of the butyl sealant under stress, in the case of a traditional frame made of hollow profiled aluminum and in the case of a spacer frame made of expanded synthetic material, for validation of the importance and industrial application of the present invention.
Figure 23B:
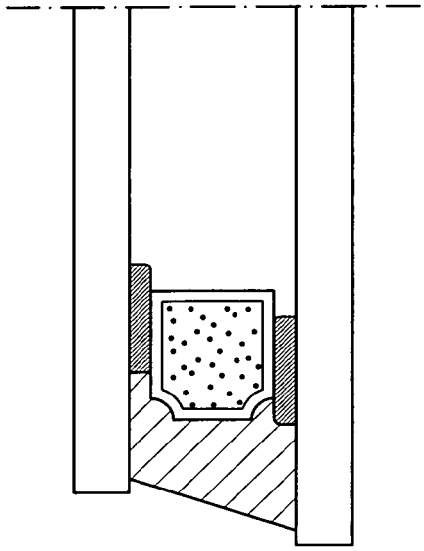
Figure 24A:
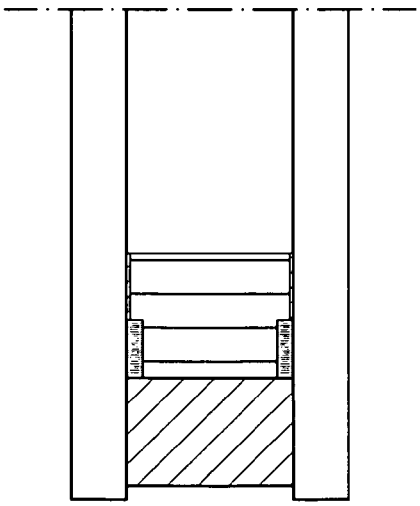
Figure 24B:
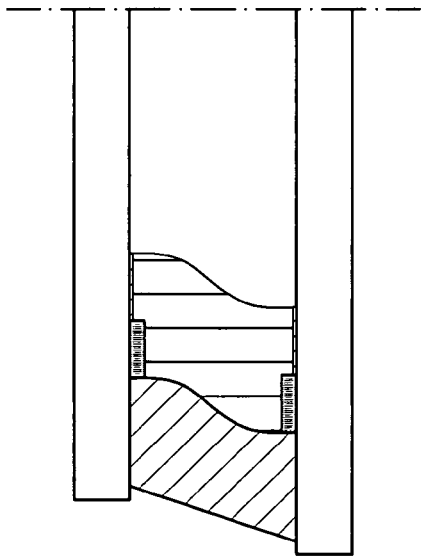

The graphical representation of FIGS. 20 and 21 refers to a machine 1000 for applying a spacer profile 3, in which the source machine (washing unit) 4000 is placed to the left and the destination machine (mating unit) 5000 is arranged to the right of it (with reference to the flow of the process); it is easy to imagine a description and corresponding figures in the case of mirror-symmetrical or otherwise different arrangements, such as those of FIGS. 2 to 18, which illustrate an orientation that is opposite to the orientation of FIGS. 20 and 21.

Of course, all the movements linked to the steps of the cycle are mutually interlocked by the aid of a logic system that is parallel but always active, for avoiding, during the process, conditions of mutual interference between actuator elements and material being processed (glass sheets 2 and spacer profile 3).

The present invention is susceptible of numerous constructive variations (with respect to what is shown in and can be deduced from the drawings, the details of which are evident and eloquent), all of which are within the scope of the appended claims.

Thus, for example, the mechanical solutions for the movement of the compensation roller 608; the actuation means, which can be electrical, electrical-electronic, pneumatic, oil pressure-operated and/or combined, etcetera; the control means, which can be electronic or fluidic and/or combined, etcetera, can all be provided, according to the requirements, by known equivalent means.

Figure 19B:
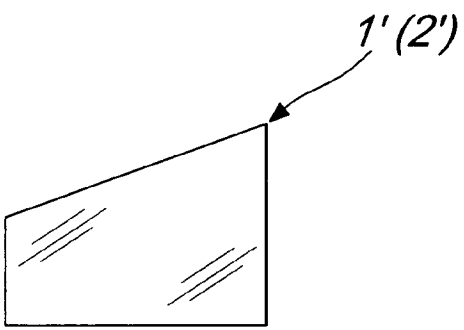
Figure 19C:
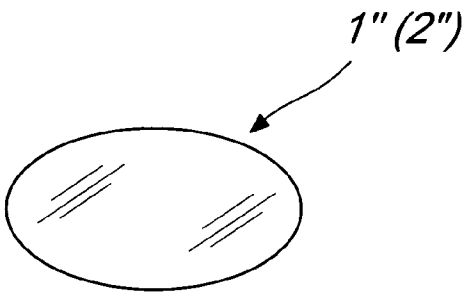
Figure 19D:
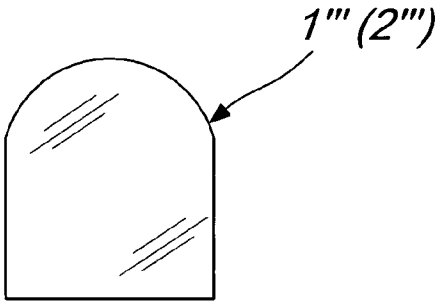

An important process and construction variation consists in the logical combination of the actuation systems for horizontal translational motion H of the glass sheet [assembly 100], for vertical translation V of the head [assembly 200] for rotation $\phi$ of the head [also assembly 200] and translational motion T of the belts of the belt transmission device 210*a*, 210*b* [assembly 200], respectively, for allowing the application of the spacer profile 3 on glass sheets 2' (FIG. 19B) whose shape is other than rectangular because it is a regular or irregular polygonal shape, or on glass sheets 2" (FIG. 19C) whose shape is other than rectangular because it is curvilinear, or on glass sheets 2''' (FIG. 19D) whose shape is other than rectangular because it consists of linear and curvilinear parts.

To achieve this, as a completion of what has been described earlier concerning the concatenation of the electrical activations of the axes H, V, $\phi$ and T, i.e., of the respective four motors 102, 202, 232 and 214*a*, 214*b*, adequate systems for detecting shapes and dimensions (for example by means of a scanner) can be integrated in the line for the production of the insulating glazing unit 1 together with systems for marking the glass sheets and together with systems for reading said markings.

As the ones skilled in the art would readily recognize, the constructive details can be replaced with other technically equivalent ones. The materials and the dimensions may be any according to requirements, in particular those arising from the dimensions (base and height) of the glass sheets 2.

Industrial application of the present invention is immediately apparent, machines for the automatic application of the spacer profile made of expanded synthetic material on glass sheets being largely usable in the field, albeit limitedly to the application of the spacer profile 3 that belonged to the dual seal technology with a first seal 5 provided by the acrylic adhesive and a second seal 7 provided by the hot melt sealant. This technology, however, is not sufficient in fields such as structural glazing, where the last sealant must be silicone-based, or in many other applications, in which the last sealant must be of the polysulfide or polyurethane type. In such situations, since the hot melt sealant, which is the one that ensures the tightness against water vapor and gas, is not provided, it is necessary to use the intermediate sealant 6 made of thermoplastic material, and therefore one must resort to the subject of the present invention for its application according to best practice, since it is innovative indeed in the way of extruding and spreading the intermediate sealant 6 that is not affected by the discontinuity of the subsequent process for application of the spacer profile 3 on the glass sheet 2. The range of insulating glazing units required has been increased and improved by all those configurations that require the use of special types of glass which are therefore heavy like the ones described in the preamble of the description (and in particular very thick ones, such as tempered glass sheets, laminated glass sheets, and armored glass sheets), which are thus coupled advantageously right from the very first mating with the spacer frame 3, if said frame is of the type to which the present invention relates, differently from the traditional type, which requires catalysis of the final sealant before the joint between the glass sheets and the frame can be subjected to stresses by means of mechanical loads. Moreover, shapes that differ from the rectangular one because they are polygonal or curvilinear or mixed are successfully obtainable according to the present invention, which is aimed at providing according to best practice the intermediate seal 6 particularly in a manner that is not disturbed by discontinuities, interruptions, irregularities that are typical of the methods of the background art. Moreover, the machine with the device according to the present invention can be inserted easily on lines for the production of an insulating glazing unit of the traditional type (i.e., the one with the spacer frame made of a hollow profile according to FIGS. 1A, 1B, 1C), making said lines conveniently dual-purpose, i.e., operative both with a traditional spacer frame and with a spacer frame made of expanded synthetic material, or rather triple-purpose, since the spacer frame made of expanded synthetic material can be both of the dual seal type and of the TriSeal™ type and the application head 200 can apply both said types of spacer profile 3.

Insertion of a machine according to the present invention, in the line for the production of the insulating glazing unit, is shown in FIGS. 20 and 21 (perspective view and plan view).

An important reason for the success of the spread of TriSeal™ technology with the spacer profile 3 made of expanded synthetic material over the spread of the dual seal technology with a spacer frame made of hollow profiled aluminum and hence for the success of the present invention, which improves the extrusion process of the thermoplastic sealant 6, and therefore the sealing characteristics of the TriSeal™, as follows.

The traditional dual seal system with a spacer frame made of hollow profiled aluminum or hollow profiled plastic suffers from the fact that due to the rigidity of the cross-section of the profile that constitutes the frame, the inevitable differential expansions between the glass sheet 2 exposed to a higher temperature and the glass sheet 2 exposed to a lower temperature entail the flow of the butyl thermoplastic sealant, compromising its efficiency and thus reducing the tightness to water vapor and gas. With the TriSeal™ technology with a spacer profile 3 made of expanded synthetic material, in addition to the advantages of higher thermal insulation (and therefore of the elimination of the thermal bridge at the peripheral region of the insulating glazing unit 1) that are already very well-known, the differential expansions cited above are withstood due to the elastic deformability of the profile itself.

Therefore, the second thermoplastic butyl sealant 6 does not flow with respect to the glass sheet both due to the presence of the first acrylic adhesive sealant, which keeps the spacer profile 3 locally coupled to the glass sheet 2, and due to less stress, for an equal expansion, because said stress is attenuated by the elasticity of the spacer profile 3. This is particularly important in structural glazing, where silicone is used as a third sealant (a two-part sealant which can be catalyzed at ambient temperature) and, being particularly elastic, allows greater differential expansion of the glass sheets 2. This concept is illustrated schematically in FIGS. 23A, 23B and 24A, 24B, which simulate the behavior of the peripheral joints of the insulating glazing unit 1 when subjected to the stress produced by the differential expansions of the glass sheets 2 (the shadings used are the ones of FIGS. 1A and 1F).

The disclosures in Italian Patent Application No. TV2008A000129 from which this application claims priority are incorporated herein by reference.

What is claimed is:

1. An automatic machine for manufacturing an insulating glazing unit, comprising:

conveyors with a substantially vertical arrangement which include transport devices provided with support and traction elements suitable to operate on edges of a first glass sheet and synchronous transmission means that operate on a face of the first glass sheet along a horizontal axis;

a spacer profile application head adapted to apply a spacer profile to the first glass sheet and provided so as to perform a synchronous translational motion along a vertical axis and a synchronous rotary motion along a rotational axis;

translation actuator means for actuating said application head in said translational motion;

rotation actuation means for actuating said application head in said rotary motion;

traction means arranged in said application head for the synchronous traction of the spacer profile in said application head;

a spool of the spacer profile which is wound to form said spool, the spacer profile being made of expanded synthetic material and having, on each side thereof, two regions designed for sealants, respectively with an adhesion function and with a sealing function, the spacer profile being provided wound in said spool only with the adhesive function sealant protected by a removable film for feeding the spacer profile by unwinding actuated in a regulated manner and so that said spacer profile is cut in places that form corners and cusps of a formed frame;

mechanisms of said application head for applying along a side thereof the spacer profile on a glass sheet discontinuously and intermittently on a further glass sheet of progressive insulating glazing units;

a spool unwinding apparatus adapted to unwind said spacer profile from said spool;

an extrusion assembly located between the unwinding apparatus of the spool and said traction means of the application head with respect to a feed direction of the spacer frame said unwinding apparatus and said traction means, said extrusion assembly being adapted to apply the second sealing function sealant on said spacer profile unwound from said spool;

extrusion nozzles provided at the extrusion assembly and that have modulated, uninterrupted flow-rate, at least during application of the entire spacer profile on a corresponding first glass sheet, constituting, after mating of a second glass sheet, a complete insulating glazing unit; and a compensation assembly arranged between said extrusion assembly and said traction means with respect to said feed direction of the spacer frame, said compensation assembly being provided a positioning wheel adapted to engage the spacer frame to provide a variable accumulation of the spacer frame, and being controlled by synchronous actuation of a motor as a function of the discontinuous operation of the application head and of continuous activity of the extrusion head, for providing continuity of extrusion operation.

2. The automatic machine of claim 1, comprising at least two opposite said nozzles, at least a first one of said nozzles for extrusion of the second sealant being adjustable, by way of an actuator, with respect to a second opposite one, and therefore with respect to faces of the spacer profile, both for providing symmetric and optimum play for extrusion in contact with said faces and for adapting extrusion to a transverse dimension of the spacer profile, measured by a measuring device located in the unwinding apparatus.

3. The automatic machine of claim 1, comprising synchronous actuators which are linked electrically and logically to one or more or all of a group of actuators comprising: a synchronous motor for synchronous traction of the glass sheet along the horizontal axis, a synchronous motor for synchronous movement of the head along the vertical axis, a synchronous motor for synchronous rotation of the head along the rotational axis, a synchronous motor for traction of the spacer profile along a longitudinal axis, a synchronous motor for traction of the spacer profile at the extrusion nozzles, a motor of the compensation assembly and a synchronous motor of a traction assembly, for providing modulation of the flow-rate of the second sealant.

4. The automatic machine of claim 2, further comprising flow control elements of a spool type actuated by synchronous motors for providing modulation of the flow-rate of the second sealant

5. The automatic machine of claim 2, further comprising flow control elements of a needle type, which are actuated by synchronous motors for providing modulation of the flow-rate of the second sealant.

6. The automatic machine of claim 2, wherein modulation of the flow-rate of the second sealant is independent for each one of said nozzles.

* * * * *